US010762738B2

(12) United States Patent
Machida et al.

(10) Patent No.: US 10,762,738 B2
(45) Date of Patent: Sep. 1, 2020

(54) CASH MANAGEMENT SYSTEM, CASHIER DEVICE, AND CASH MANAGEMENT METHOD

(71) Applicant: GLORY LTD., Himeji-shi, Hyogo (JP)

(72) Inventors: Shoichiro Machida, Himeji (JP); Seiji Kiyose, Himeji (JP); Minami Yamashita, Himeji (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 16/083,484

(22) PCT Filed: Mar. 2, 2017

(86) PCT No.: PCT/JP2017/008354
§ 371 (c)(1),
(2) Date: Sep. 7, 2018

(87) PCT Pub. No.: WO2017/154742
PCT Pub. Date: Sep. 14, 2017

(65) Prior Publication Data

US 2019/0073854 A1 Mar. 7, 2019

(30) Foreign Application Priority Data

Mar. 9, 2016 (JP) ..... 2016-046236

(51) Int. Cl.
*G07D 11/24* (2019.01)
*G07D 11/34* (2019.01)
(Continued)

(52) U.S. Cl.
CPC ..... *G07D 11/32* (2019.01); *G07D 9/00* (2013.01); *G07D 11/0087* (2013.01);
(Continued)

(58) Field of Classification Search
None
See application file for complete search history.

(56) References Cited

U.S. PATENT DOCUMENTS 6,848,612 B2 * 2/2005 Uematsu ..... G06Q 40/02 235/379
8,640,945 B1 2/2014 McCormick
(Continued)

FOREIGN PATENT DOCUMENTS

JP 2001-109959 A 4/2001
JP 2007-241531 A 9/2007
(Continued)

OTHER PUBLICATIONS

Extended European Search Report, App. No. 17763082.9 (dated Feb. 20, 2019).
(Continued)

*Primary Examiner* — Christie I Marshall
(74) *Attorney, Agent, or Firm* — Foley & Lardner LLP

(57) ABSTRACT

A cash management system includes a plurality of cash settlement devices, a cashier device, and a cash management device, wherein the cash management device acquires the inventory number in each cash settlement device, and when a request is made to supply change funds, calculates the total number of banknotes or coins lacking relative to the preset post-replenishment inventory number thereof, wherein the cash management device instructs the cashier device to, when the total number is equal to or less than the inventory number in the cashier device, dispense banknotes or coins, the number of the dispensed banknotes or coins being required to allow the inventory number in the cash settlement device to reach the post-replenishment inventory number, and when the total number exceeds the inventory number in the cashier device, dispense banknotes or coins,
(Continued)

the number of the dispensed banknotes or coins being calculated according to a preset calculation formula.

21 Claims, 18 Drawing Sheets

(51) Int. Cl.

| | |
|---|---|
| ***G07D 11/00*** | (2019.01) |
| ***G07D 11/32*** | (2019.01) |
| ***G07G 1/14*** | (2006.01) |
| ***G07D 9/00*** | (2006.01) |
| ***G07G 1/00*** | (2006.01) |
| ***G07F 19/00*** | (2006.01) |
| ***G07F 5/24*** | (2006.01) |
| ***G07D 11/245*** | (2019.01) |

(52) U.S. Cl.
CPC ..... *G07D 11/24* (2019.01); *G07D 11/245* (2019.01); *G07D 11/34* (2019.01); *G07F 5/24* (2013.01); *G07F 19/211* (2013.01); *G07G 1/00* (2013.01); *G07G 1/0027* (2013.01); *G07G 1/14* (2013.01)

(56) References Cited

U.S. PATENT DOCUMENTS

| | | | | |
|---|---|---|---|---|
| 2018/0286163 | A1* | 10/2018 | Shimizu | G07D 9/006 |
| 2019/0026970 | A1* | 1/2019 | Doi | G07D 1/00 |

FOREIGN PATENT DOCUMENTS

| | | | |
|---|---|---|---|
| JP | 2008-197832 | A | 8/2008 |
| JP | 2010-218294 | A | 9/2010 |
| JP | 2012-185862 | A | 9/2012 |
| JP | 2013-156678 | A | 8/2013 |

OTHER PUBLICATIONS

Translation of International Search Report, PCT/JP2017/008354, 1 page (dated Jun. 6, 2017).

* cited by examiner

FIG. 10

| | CASHIER DEVICE | FIRST CASH SETTLEMENT DEVICE | SECOND CASH SETTLEMENT DEVICE | THIRD CASH SETTLEMENT DEVICE | FOURTH CASH SETTLEMENT DEVICE | |
|---|---|---|---|---|---|---|
| DEFAULT | 10 | 10 | 10 | 10 | 10 | |
| INVENTORY NUMBER (A) AT REPLENISHMENT REQUEST | Ac=10 | 2 | 6 | 6 | 8 | |
| POST-REPLENISHMENT INVENTORY NUMBER (B) | | 10 | 10 | 10 | 10 | |
| NUMBER OF BANKNOTES OR COINS LACKING (C) = (B) − (A) | | 8 | 4 | 4 | 2 | SUM (Tc) 18 |
| APPORTIONMENT RESULT | | 4 | 2 | 2 | 1 | |
| DISPENSING | 6 | 4 | | | | |

FIG. 11

| | CASHIER DEVICE | FIRST CASH SETTLEMENT DEVICE | SECOND CASH SETTLEMENT DEVICE | THIRD CASH SETTLEMENT DEVICE | FOURTH CASH SETTLEMENT DEVICE | |
|---|---|---|---|---|---|---|
| DEFAULT | 100 | 150 | 150 | 150 | 150 | |
| INVENTORY NUMBER (A) AT REPLENISHMENT REQUEST | Ac=100 | 20 | 0 | 120 | 162 | |
| POST-REPLENISHMENT INVENTORY NUMBER (B) | | 150 | 150 | 150 | 150 | |
| NUMBER OF BANKNOTES OR COINS LACKING (C) = (B) − (A) | | 130 | 150 | 30 | 0 | SUM (Tc) 310 |
| APPORTIONMENT RESULT | | 41 | 48 | 9 | 0 | |
| DISPENSING | 52 | | 48 | | | |

FIG. 12

| | CASHIER DEVICE | FIRST CASH SETTLEMENT DEVICE | SECOND CASH SETTLEMENT DEVICE | THIRD CASH SETTLEMENT DEVICE | FOURTH CASH SETTLEMENT DEVICE | |
|---|---|---|---|---|---|---|
| DEFAULT | 100 | 150 | 150 | 150 | 150 | |
| INVENTORY NUMBER (A) AT REPLENISHMENT REQUEST | Ac=100 | 20 | 0 | 120 | 162 | |
| POST-REPLENISHMENT INVENTORY NUMBER (B) | | 150 | 150 | 150 | 150 | |
| NEARLY EMPTY VALUE | | 20 | 20 | 20 | 20 | |
| NUMBER OF BANKNOTES OR COINS LACKING (C) = (B) - (A) | | 130 | 150 | 0 | 0 | SUM (Tc) 280 |
| APPORTIONMENT RESULT | | 46 | 53 | 0 | 0 | |
| DISPENSING | 47 | | 53 | | | |

FIG. 13

| | CASHIER DEVICE | FIRST CASH SETTLEMENT DEVICE | SECOND CASH SETTLEMENT DEVICE | THIRD CASH SETTLEMENT DEVICE | FOURTH CASH SETTLEMENT DEVICE | |
|---|---|---|---|---|---|---|
| BUSYNESS FLAG | | ON | OFF | ON | ON | |
| DEFAULT | 100 | 150 | 150 | 150 | 150 | |
| INVENTORY NUMBER (A) AT REPLENISHMENT REQUEST | Ac=100 | 50 | 0 | 120 | 162 | |
| POST-REPLENISHMENT INVENTORY NUMBER (B) | | 150 | 0 | 150 | 150 | |
| NUMBER OF BANKNOTES OR COINS LACKING (C) = (B) − (A) | | 100 | 0 | 30 | 0 | SUM (Tc) 130 |
| APPORTIONMENT RESULT | | 76 | 0 | 23 | 0 | |
| DISPENSING | 24 | 76 | | | | |

FIG. 14

| | CASHIER DEVICE | FIRST CASH SETTLEMENT DEVICE | SECOND CASH SETTLEMENT DEVICE | THIRD CASH SETTLEMENT DEVICE | FOURTH CASH SETTLEMENT DEVICE | |
|---|---|---|---|---|---|---|
| SETTING OF BUSYNESS | | BUSY REGISTER | NORMAL REGISTER | SLACK REGISTER | INACTIVE REGISTER | |
| APPORTIONMENT RATIO (r) | | 150% | 100% | 50% | 0% | |
| DEFAULT | 100 | 100 | 100 | 100 | 100 | |
| INVENTORY NUMBER (A) AT REPLENISHMENT REQUEST | Ac=100 | 10 | 20 | 100 | 0 | |
| REFERENCE INVENTORY NUMBER (D) | | 100 | 100 | 100 | 100 | |
| POST-REPLENISHMENT INVENTORY NUMBER (B) = (D) × (r) | | 150 | 100 | 50 | 0 | |
| NUMBER OF BANKNOTES OR COINS LACKING (C) = (B) − (A) | | 140 | 80 | 0 | 0 | SUM (Tc) 220 |
| APPORTIONMENT RESULT | | 63 | 36 | 0 | 0 | |
| DISPENSING | 37 | 63 | | | | |

CASH MANAGEMENT SYSTEM, CASHIER DEVICE, AND CASH MANAGEMENT METHOD

CROSS-REFERENCE TO RELATED APPLICATIONS

This application is a National Stage Application of International Application No. PCT/JP2017/008354, filed Mar. 2, 2017, which claims the benefit of and priority to Japanese Patent Application No. 2016-046236, filed Mar. 9, 2016, both of which are incorporated herein by reference in their entireties.

TECHNICAL FIELD

The present disclosure relates to a cash management system, a cashier device, and a cash management method.

BACKGROUND ART

Patent Document 1 describes a cash handling device shared by a plurality of shops. This cash handling device dispenses cash for use as change in a register of each shop (i.e., change funds). The register of the shop is previously registered with the cash handling device. A person in charge of each shop operates the cash handling device to request supply of change funds if necessary. Unless, when a request is made to replenish a register of a certain shop with change funds, the inventory number of a target denomination of banknotes or coins for replenishment in the cash handling device is nearly empty, the cash handling device dispenses, as change funds, banknotes or coins whose number meets the request. On the other hand, if the inventory number of the target denomination of banknotes or coins for replenishment in this device is nearly empty, the cash handling device dispenses, as change funds, banknotes or coins whose number is obtained by dividing the inventory number in this device by the number of the registered registers. Thus, this cash handling device can prevent all the cash in this device from being dispensed to a particular register when the inventory number in this device is low. As a result, the cash handling device can dispense change funds to as many registers as possible before being replenished with cash for change funds.

Patent Document 2 describes a cash management system including a plurality of point of sales (POS) terminals each provided with a cash settlement device capable of dispensing change. This cash management system includes a main POS terminal acquiring the inventory number of banknotes or coins in each of the cash settlement devices, and compares the inventory number with preset data on change funds, thereby calculating the shortage of change funds for the next business day.

CITATION LIST

Patent Documents

Patent Document 1: Japanese Patent No. 5200388
Patent Document 2: Japanese Patent No. 5202403

SUMMARY OF THE INVENTION

Technical Problem

As described also in Patent Document 1, in a cash management system including a plurality of registers and a plurality of cash settlement devices, when the inventory number of banknotes or coins in a cashier device that dispenses change funds is low, a need arises to appropriately dispense change funds to as many cash settlement devices as possible.

In this connection, when the inventory number of banknotes or coins in the cashier device is low, the system described in Patent Document 1 described above dispenses banknotes or coins whose number is obtained by dividing the inventory number by the number of the registered registers (i.e., the cash settlement devices). This allows many cash settlement devices to be replenished with change funds. However, for example, some of the cash settlement devices do not have to be replenished, because a sufficient amount of change funds remain in each of the devices. In that case, evenly distributing the inventory number in the cashier device among the cash settlement devices as in the system described in Patent Document 1 prevents a sufficient amount of change funds from being allocated to a cash settlement device that needs to be replenished with change funds.

In view of the foregoing background, it is therefore an object of the present disclosure to provide a cash management system that, when the inventory number of banknotes or coins in a cashier device dispensing change funds is low, appropriately replenishes, with change funds, a cash settlement device that needs to be replenished.

Solution to the Problem

The present disclosure relates to a cash management system, including: a plurality of cash settlement devices corresponding to a plurality of registers, respectively, which store change funds, wherein the plurality of cash settlement devices are operable to dispense stored cash as at least change to be paid back to a customer; a cashier device operable to store sales proceeds of the plurality of registers, and when a request is made to supply the change funds on a denomination-by-denomination basis, operable to dispense a particular denomination of the cash stored in the cashier device; and a cash management device connected to the plurality of cash settlement devices and the cashier device to exchange a signal with each of the plurality of cash settlement devices and the cashier device, the cash management device controlling how the cashier device dispenses the cash.

A post-replenishment inventory number of banknotes or coins in each cash settlement device is determined on a denomination-by-denomination basis, the post-replenishment inventory number serving as a standard for supplying the change funds, the cash management device acquires an inventory number of banknotes or coins as the change funds in each cash settlement device of the cash management system, and when a request is made to supply the change funds, calculates the total number of an associated denomination of banknotes or coins lacking in each cash settlement device of the cash management system relative to the post-replenishment inventory number, based on the inventory number of the denomination of the change funds associated with the request.

The cash management device further instructs the cashier device to, dispense the denomination of banknotes or coins as the change funds for the cash settlement device associated with the request when the total number of a denomination of the banknotes or coins lacking is equal to or less than an inventory number of the denomination of banknotes or coins in the cashier device, the dispensed banknotes or coins being required to allow the inventory number of banknotes or coins in the cash settlement device to be equal to the post-replenishment inventory number, and instructs the cashier device to, dispense the denomination of banknotes or coins as the change funds for the cash settlement device associated with the request when the total number of a denomination of the banknotes or coins lacking exceeds the inventory number of the denomination of banknotes or coins in the cashier device, the number of the dispensed banknotes or coins being calculated according to a preset calculation formula.

According to this configuration, the cashier device of the cash management system stores sales proceeds of the registers in the cash management system, and dispenses the change funds with which the cash settlement devices are to be replenished.

The cash management device acquires the inventory number of banknotes or coins as change funds in each cash settlement device of the cash management system. The timing at which the cash management device acquires the inventory number of banknotes or coins in the cash settlement device can be appropriately set.

For example, when a request is made to supply the change funds (specifically, when a person in charge operates the cashier device, for example, to request dispensing of money to supply change funds), the cash management device may acquire the inventory number of the change funds in each cash settlement device of the cash management system on a denomination-by-denomination basis.

The cash management device may acquire the inventory number of banknotes or coins as the change funds in each cash settlement device of the cash management system at regular intervals.

When acquiring the inventory numbers of banknotes or coins as change funds in the cash settlement devices of the cash management system, the cash management device may acquire the inventory numbers of each denomination of banknotes or coins as change funds in all of the cash settlement devices of the cash management system, or may acquire the inventory number(s) of each denomination of banknotes or coins as change funds in one or more of the cash settlement devices that may need to be replenished with change funds in the future.

When a request is made to supply change funds, the cash management device calculates the total number of a denomination of banknotes or coins lacking relative to the post-replenishment inventory number of banknotes or coins in each cash settlement device of the cash management system, based on the inventory number of the denomination of banknotes or coins as change funds. Also in this case, the cash management device may calculate the total number of a denomination of banknotes or coins lacking relative to the post-replenishment inventory number in each of the cash settlement devices of the cash management system, or may calculate the total number of the denomination of banknotes or coins lacking relative to the post-replenishment inventory number in each of one or more of the cash settlement devices that may need to be replenished with change funds in the future.

This enables determination of how much change funds are lacking in all of the cash settlement devices of the cash management system.

When the total number of the denomination of banknotes or coins lacking is equal to or less than the inventory number of the denomination of banknotes or coins in the cashier device, the cash management device determines that the inventory number of the denomination of banknotes or coins in the cashier device is sufficiently left, and instructs the cashier device to dispense the denomination of banknotes or coins, the number of the dispensed banknotes or coins being required to allow the inventory number of the denomination of banknotes or coins in one of the cash settlement devices associated with the request to be equal to the preset post-replenishment inventory number. The cashier device dispenses the denomination of banknotes or coins. The number of the banknotes or coins is equal to the indicated number of banknotes or coins. The person in charge receives cash dispensed, and stores the denomination of cash in the corresponding cash settlement device. As a result, the inventory number of banknotes or coins as change funds in the cash settlement device is equal to the post-replenishment inventory number.

On the other hand, when the total number of the denomination of banknotes or coins lacking exceeds the inventory number of the denomination of banknotes or coins in the cashier device, the cash management device determines that the inventory number of banknotes or coins in the cashier device is low, and limits the amount of cash to be dispensed. Specifically, the cash management device instructs the cashier device to dispense a denomination of banknotes or coins. The number of the denomination of the banknotes or coins is equal to the number of banknotes or coins calculated according to the preset calculation formula. The cashier device dispenses the denomination of banknotes or coins in the same way as described above. The number of the denomination of the banknotes or coins is equal to the indicated number of banknotes or coins. The person in charge receives cash dispensed, and stores the denomination of cash in the corresponding cash settlement device. As a result, the inventory number of banknotes or coins as change funds in the cash settlement device is less than the post-replenishment inventory number.

According to this configuration, when the inventory number of banknotes or coins in the cashier device is low, the amount of change funds dispensed is limited. This can prevent all the cash in the cashier device from being dispensed to a specific one of the cash settlement devices, and can prevent change funds from being unable to be dispensed to the other cash settlement devices.

Cash in the cashier device is dispensed as change funds not based on the preset nearly empty value but based on the inventory number of an associated denomination of banknotes or coins in each cash settlement device of the cash management system as described above. This allows one or more of the cash settlement devices that need(s) to be replenished to be replenished with a sufficient amount of change funds. That is to say, the cash settlement device(s) that need(s) to be replenished can be appropriately replenished with change funds.

When the total number of a denomination of banknotes or coins lacking exceeds the inventory number of banknotes or coins in the cashier device, the cash management device may be operable to perform an apportionment that apportions the inventory number of the banknotes or coins in the cashier device among one or more of the cash settlement devices in which change funds are lacking, according to a ratio of the number of the denomination of banknotes or coins lacking in the one or more of the cash settlement devices to the total number of the denomination of banknotes or coins lacking, and the cash management device may instruct the cashier device to dispense the apportioned number of the denomination of banknotes or coins.

Thus, when dispensing of change funds from the cashier device is limited, the inventory number of a denomination of banknotes or coins in the cashier device is apportioned among the cash settlement devices according to the ratios of the numbers of the denomination of banknotes/coins lacking in the cash settlement devices to the total number of the denomination of banknotes/coins lacking in all of the cash settlement devices of the cash management system. This allows an appropriate number of the denomination of banknotes or coins as change funds to be dispensed to one of the cash settlement devices that needs to be replenished with change funds.

Every time the cashier device dispenses the change funds to any one of the cash settlement devices, the cash management device may perform the apportionment.

This allows the inventory number of banknotes or coins in the cashier device to be appropriately apportioned at a timing at which the cashier device dispenses change funds.

Here, the post-replenishment inventory numbers of banknotes or coins as change funds in the registers and the cash settlement devices in the cash management system may be set to be equal to one another. The frequency at which change funds are used may vary according to the installation sites of the registers (i.e., the difference among counters or the difference among shops). In this case, it is recommended that a cash settlement device that uses change with a high frequency be replenished with a large amount of change funds.

To satisfy the need, a priority order of the plurality of cash settlement devices may be previously determined according to the respective corresponding registers, and the cash management device may apportion the inventory number of the banknotes or coins in the cashier device in accordance with the priority order.

This allows a cash settlement device with higher priority to be replenished with a relatively large amount of change funds.

The post-replenishment inventory numbers of banknotes or coins in the plurality of cash settlement devices may be determined in accordance with the priority order so that the post-replenishment inventory number of banknotes or coins in one of the plurality of cash settlement devices with higher priority is higher, and the cash management device may calculate a total number of each denomination of banknotes or coins lacking, based on the post-replenishment inventory number determined in accordance with the priority order, and may apportion the inventory number of banknotes or coins in the cashier device as cash for supplying the denomination of the banknotes or coins lacking.

This increases the post-replenishment inventory number of banknotes or coins in the cash settlement device with higher priority. Thus, the number of banknotes or coins lacking tends to be relatively high, and the number of banknotes or coins apportioned to the cash settlement device with higher priority also tends to be high. This allows a relatively large amount of change funds to be apportioned to a cash settlement device with higher priority, which can be replenished with the change funds.

When an amount of the change funds in a respective cash settlement device is smaller than a preset reference amount, the respective cash settlement device may determine that the amount of the change funds is insufficient, and when a request is made to supply the change funds, the cash management device may calculate the total number of a denomination of banknotes or coins lacking relative to the post-replenishment inventory number in the respective cash settlement device in which the change funds are lacking.

Thus, a cash settlement device in which the inventory number of a concerned denomination of banknotes or coins as change funds is high and which may not have to be replenished with change funds is excluded from targets in which the number of the denomination of banknotes or coins lacking as change funds is to be calculated. Thus, in view of the inventory number of banknotes or coins as change funds in only a cash settlement device that may need to be replenished with change funds, the cash management system limits dispensing of money from the cashier device, and replenishes, with change funds, a cash settlement device associated with the request. As a result, a cash settlement device associated with the request can be appropriately replenished with change funds.

The present disclosure relates to a cashier device of a cash management system. The cash management system includes a plurality of registers, a plurality of cash settlement devices corresponding to a plurality of registers, respectively, and storing change funds, the plurality of cash settlement devices dispensing stored cash as at least change to be paid back to a customer, and a cashier device storing sales proceeds of the registers, the cashier device dispensing the cash stored in the cashier device when a request is made to replenish the plurality of registers with the change funds.

A post-replenishment inventory number of banknotes or coins in each cash settlement device is determined on a denomination-by-denomination basis, the post-replenishment inventory number serving as a standard for replenishing the cash settlement device with the change funds. The cashier device includes: an inventory number acquirer operable to acquire an inventory number of banknotes or coins as the change funds in the cash settlement device of the cash management system; a number-of-lacking-banknote/coin calculator operable to calculate a total number of a denomination, associated with the request, of banknotes or coins lacking relative to the post-replenishment inventory number in each cash settlement device of the cash management system, based on the inventory number of the denomination of banknotes or coins as the change funds, when a request is made to replenish the cash settlement device with the change funds, the inventory number being acquired by the inventory number acquirer; and a dispenser operable to dispense a particular denomination of banknotes or coins as the change funds to one of the cash settlement devices associated with the request when the total number, calculated by the number-of-lacking-banknote/coin calculator, of the particular denomination of banknotes or coins lacking is equal to or less than an inventory number of the particular denomination of banknotes or coins in the cashier device, the number of the dispensed banknotes or coins being required to allow the inventory number of banknotes or coins in the cash settlement device to reach the post-replenishment inventory number, the dispenser operable to dispense the particular denomination of banknotes or coins as the change funds to one of the cash settlement devices associated with the request when the total number of the particular denomination of banknotes or coins lacking exceeds the inventory number of the particular denomination of banknotes or coins in the cashier device, the number of the dispensed banknotes or coins being calculated according to a preset calculation formula.

The present disclosure further relates to a cash management method for a cash management system. The cash management system includes: a plurality of cash settlement devices provided to correspond to a plurality of registers, respectively, which store change funds, the plurality of cash settlement devices dispensing stored cash as at least change to be paid back to a customer; a cashier device storing sales proceeds of the registers, and when a request is made to supply the change funds on a denomination-by-denomination basis, dispensing a particular denomination of the cash stored in the cashier device; and a cash management device connected to the plurality of cash settlement devices and the cashier device to exchange a signal with each of the plurality of cash settlement devices and the cashier device, the cash management device controlling how the cashier device dispenses the cash.

A post-replenishment inventory number of banknotes or coins in each cash settlement device is determined on a denomination-by-denomination basis, the post-replenishment inventory number serving as a standard for supplying the change funds. The method includes: allowing the cash management device to acquire the inventory number of banknotes or coins as the change funds in each cash settlement device of the cash management system, and to, when a request is made to replenish one of the plurality of cash settlement devices with the change funds, calculate a total number of a denomination of banknotes or coins lacking relative to the post-replenishment inventory number in each cash settlement device of the cash management system, based on the inventory number of the denomination, associated with the request, of banknotes or coins as the change funds; when the total number of a denomination of banknotes or coins lacking is equal to or less than an inventory number of the denomination of banknotes or coins in the cashier device, allowing the cash management device to instruct the cashier device to dispense the denomination of banknotes or coins as the change funds to one of the cash settlement devices associated with the request, the number of the dispensed banknotes or coins being required to allow the inventory number of banknotes or coins in the one of the cash settlement devices to reach the post-replenishment inventory number; and when the total number of the denomination of banknotes or coins lacking exceeds the inventory number of the denomination of banknotes or coins in the cashier device, allowing the cash management device to instruct the cashier device to dispense the denomination of banknotes or coins as the change funds to the one of the cash settlement device associated with the request, the number of the dispensed banknotes or coins being calculated according to a preset calculation formula.

Advantages of the Invention

As described above, according to the cash management system, the cashier device, and the cash management method, when the inventory number of banknotes or coins in the cashier device that dispenses change funds is low, a cash settlement device that needs to be replenished can be appropriately replenished with change funds.

BRIEF DESCRIPTION OF THE DRAWINGS

FIG. 10 is a table for exemplifying how change funds are apportioned when supplied (a first apportionment example).

FIG. 11 is a table for exemplifying how change funds are apportioned when supplied (a second apportionment example).

FIG. 12 is a table for exemplifying how change funds are apportioned when supplied (a third apportionment example).

FIG. 13 is a table for exemplifying how change funds are apportioned when supplied (a fourth apportionment example).

FIG. 14 is a table for exemplifying how change funds are apportioned when supplied (a fifth apportionment example).

DESCRIPTION OF EMBODIMENTS

A cash management system, a cashier device, and a cash management method according to the present disclosure will now be described in detail with reference to the drawings. Note that the following description is illustrative.

(Configuration of Cash Management System)

Figure 1:
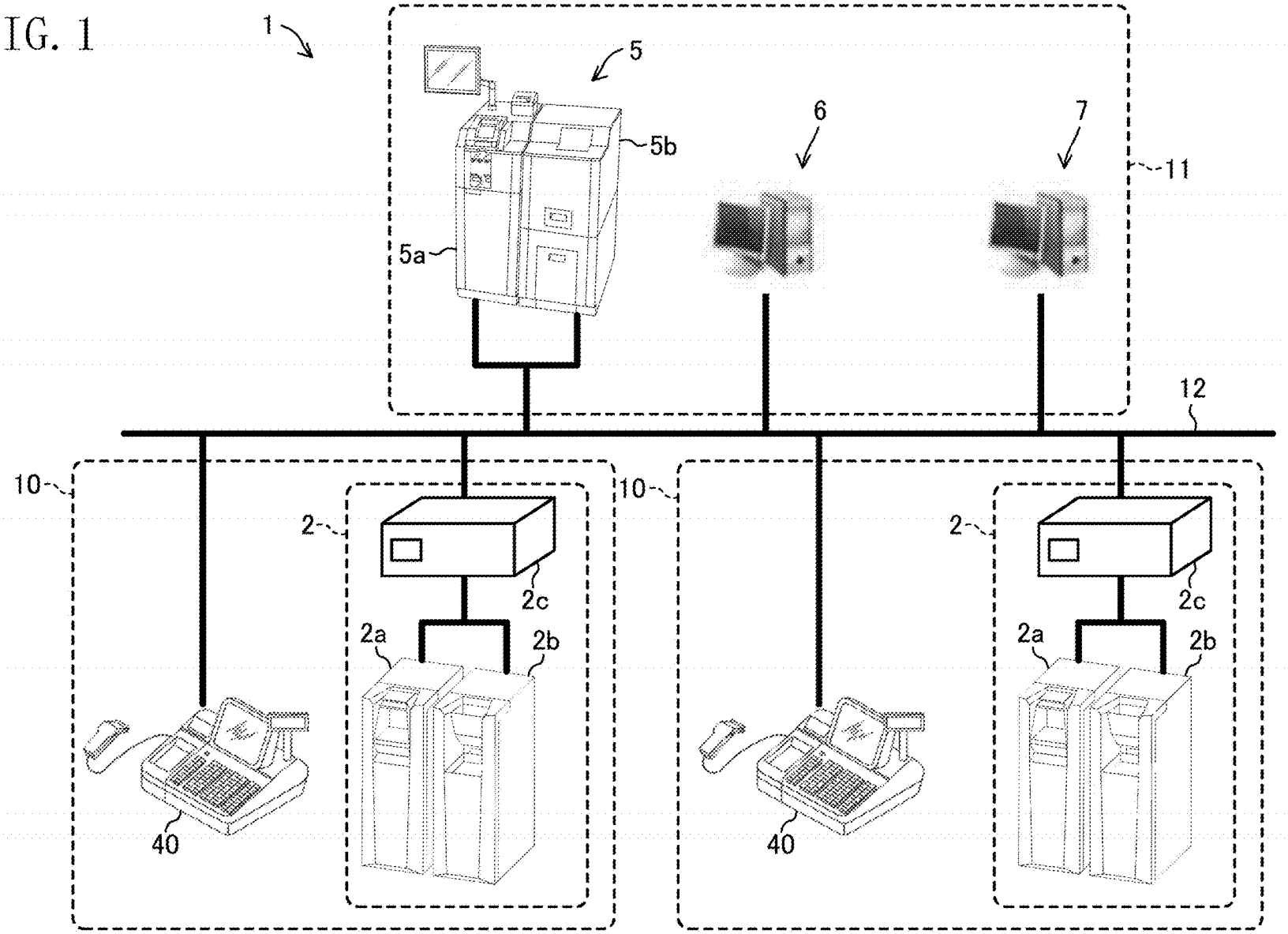
FIG. 1 shows a general configuration of a cash management system.

FIG. 1 shows a general configuration of a cash management system. A cash management system 1 is a system built for shops of retailers in a department store or a supermarket, for example. The cash management system 1 includes at least one checkout counter 10 and a back office 11. The at least one checkout counter 10 is provided in a checkout area of a shop. A salesclerk deposits and dispenses cash exchanged between the salesclerk and a customer into and from the checkout counter 10. The cash management system 1 shown in FIG. 1 includes a plurality of checkout counters 10. The back office 11 manages cash in each checkout counter 10 and commercial products. The cash management system 1 is configured to transport cash between the checkout counter 10 and the back office 11 using a cash transport cassette 30 (see FIG. 3 and other figures). Note that the cash transport cassette 30 may be replaced with a tray, a bag, a box, or any other suitable object for cash transport.

Each checkout counter 10 is provided with a cash settlement device 2 and a settlement system including a register 40. The cash settlement device 2 settles accounts with a customer if cash is deposited and dispensed thereinto and therefrom. The register 40 is communicably connected to the cash settlement device 2 via a communication line (for example, a local area network (LAN)) 12, and registers commercial products purchased by the customer. The register 40 is, for example, a POS register operated by a salesclerk.

The cash settlement device 2 is operated by a salesclerk (or a customer himself or herself) and used for a settlement process between a shop and a customer. For example, the cash settlement device 2 accepts money paid by a customer or dispenses change to the customer. The money paid by the customer may be placed in a drawer and managed by the salesclerk, and the cash settlement device 2 may merely dispense the change to be paid to the customer. In the example shown in FIG. 1, the cash settlement device 2 includes a banknote settlement machine 2*a* accepting and dispensing banknotes, a coin settlement machine 2*b* accepting and dispensing coins, and a control box 2*c* controlling the banknote settlement machine 2*a* and the coin settlement machine 2*b*.

The back office 11 includes a cashier device 5, a cash management device 6, and a POS management device 7. The cashier device 5, the cash management device 6, the POS management device 7, the registers 40, and the cash settlement devices 2 are communicably connected together via the communication line 12.

The cashier device 5 dispenses change funds with which the cash settlement devices 2 are to be replenished, and accepts sales proceeds collected from the cash settlement devices 2. In the example shown in FIG. 1, the cashier device 5 includes a banknote cashier machine 5*a* accepting and dispensing banknotes, and a coin cashier machine 5*b* accepting and dispensing coins.

The cash management device 6 manages cash stored in the cash settlement devices 2 and the cashier device 5. For example, the cash management device 6 manages cash left in each of the cash settlement devices 2 after settlements and cash exchanged between the cash settlement devices 2 and the cashier device 5. The cash management device 6 further controls how the cashier device 5 dispenses money. Although described below in detail, in the cash management system 1 according to the present disclosure, the cash management device 6 is configured to, when a request is made to replenish one of the cash settlement devices 2 with change funds, be able to appropriately dispense change funds into the cash settlement device 2 associated with the request.

The POS management device 7 is communicably connected to the registers 40 via the communication line 12 to manage the flow of commercial products and the sales of the shop.

As shown in FIGS. 3, 4, 6, 7A, 7B, and other figures, the cash transport cassette 30 is configured to be attachable and detachable to/from the cash settlement devices 2 and the cashier device 5, and can exchange cash with the associated cash settlement device 2 or the cashier device 5 when fitted to the cash settlement device 2 or the cashier device 5. On the other hand, the cash transport cassette 30 that has been detached from the cash settlement devices 2 and the cashier device 5 stores therein cash so that the cash cannot be removed. A salesclerk transports cash between the cash settlement devices 2 and the cashier device 5 using the cash transport cassette 30. For example, to replenish a cash settlement device 2 with change funds or to collect sales proceeds, the salesclerk transports cash between the cash settlement device 2 and the cashier device 5 using the cash transport cassette 30. The salesclerk cannot touch the cash in the cash transport cassette 30 during transportation of the cash. Thus, the cash can be securely transported.

The cash transport cassette 30 may be configured to carry either banknotes or coins, or may be configured to be capable of carrying both of the banknotes and the coins. The cash transport cassette 30 for banknotes may be a stack-type cassette for storing banknotes stacked or a tape reel cassette for reeling a plurality of tapes together with banknotes with one of the banknotes interposed between each adjacent pair of the tapes. The cash transport cassette 30 for coins may be a cassette for storing different denominations of coins.

Components forming the cash management system 1 will now be individually described.

Figure 2:
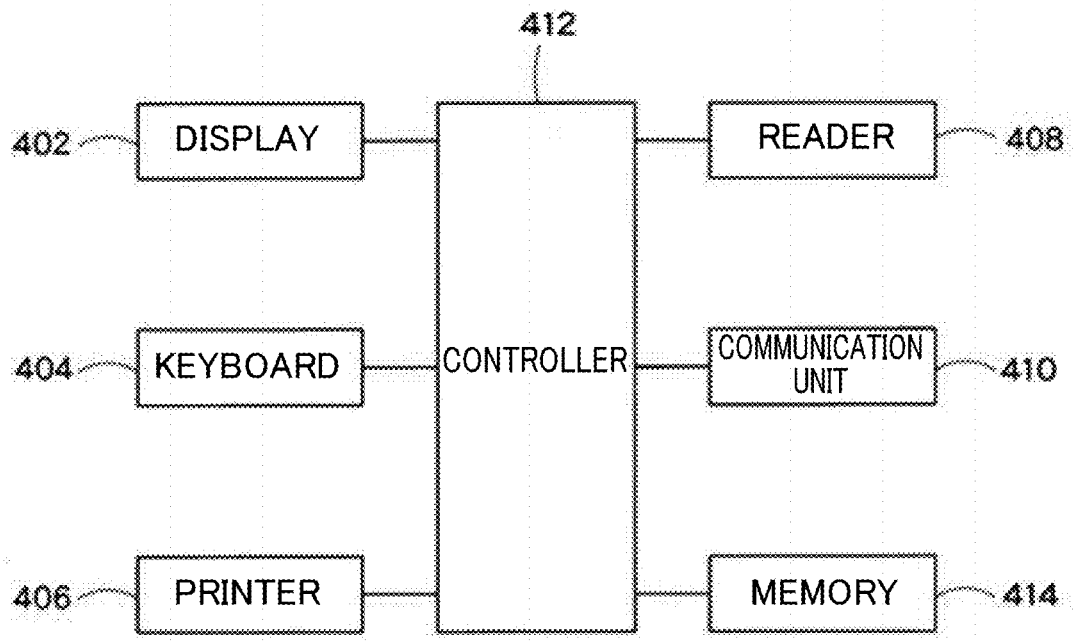
FIG. 2 is a block diagram showing a configuration of a register.

FIG. 2 is a block diagram showing a configuration of a register 40. The register 40 includes a display 402, a keyboard 404, a printer 406, a reader 408, a communication unit 410, a controller 412, and a memory 414. The display 402 displays various types of information. The keyboard 404 accepts manual input of various types of information and instructions from a salesclerk. The printer 406 outputs a receipt having transaction contents printed. The reader 408 reads product information. The communication unit 410 communicates with the associated cash settlement device 2 and the POS management device 7.

The memory 414 includes a read only memory (ROM) or a hard disk drive (HDD) storing data and various programs that control the register 40, and a random access memory (RAM) serving as an area where a program is loaded or a work area during the execution of a program. The memory 414 stores a table including a combination of information on commercial products and the prices of the commercial products.

The controller 412 is an arithmetic processing unit configured to execute a program in the memory 414 to control the entire register 40. The controller 412 uses the product information read by the reader 408 to retrieve information from the table in the memory 414, thereby obtaining the prices of commercial products and calculating the sum of the prices of commercial products purchased by a customer.

The controller 412 can transmit the sum of the prices of the purchased commercial products and the manually input information accepted by the keyboard 404 to the cash settlement device 2 via the communication unit 410. The controller 412 can further transmit information on the commercial products purchased by the customer to the POS management device 7 via the communication unit 410.

Figure 3:
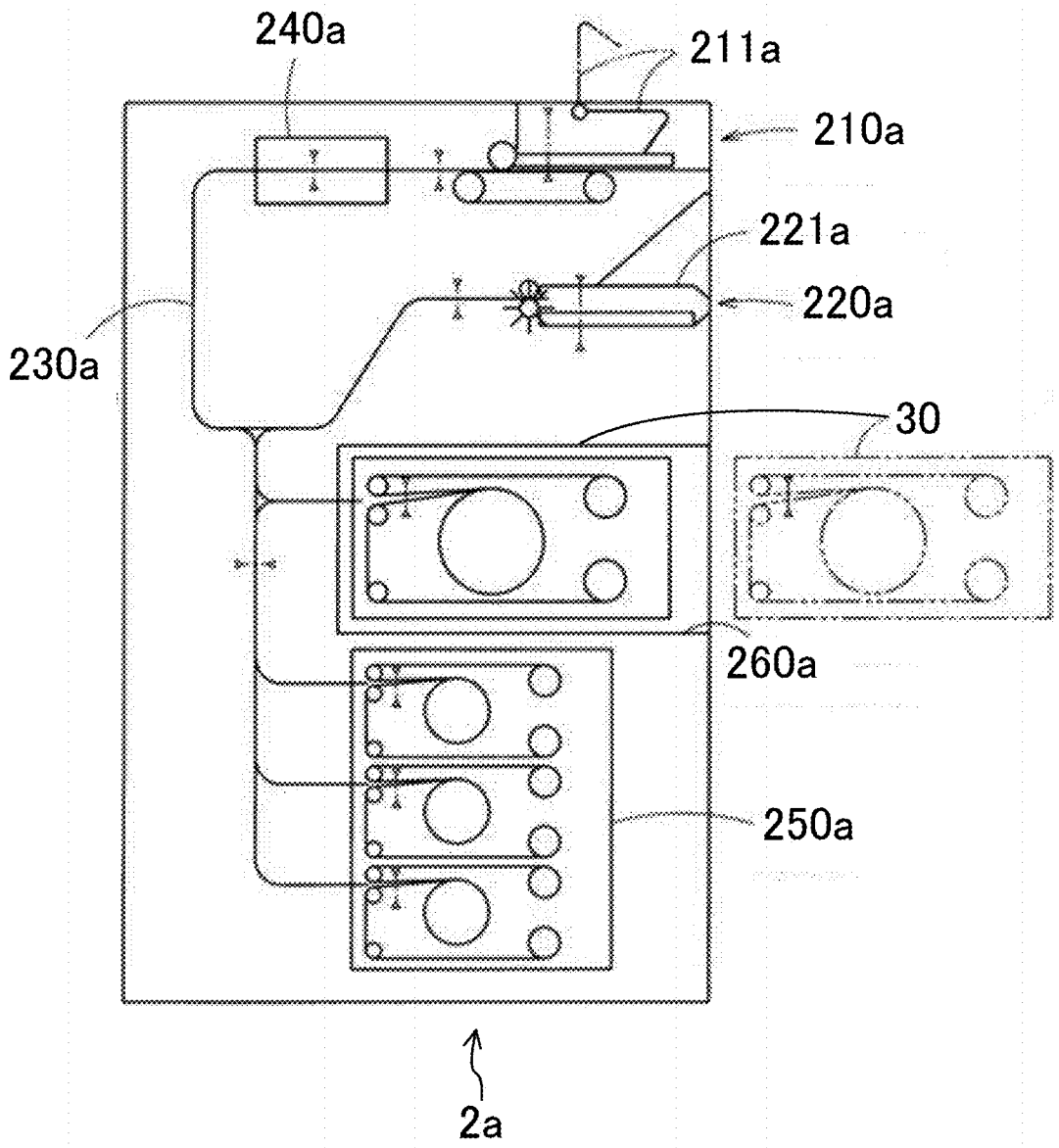
FIG. 3 is a conceptual diagram showing an internal structure of a banknote settlement machine.

FIG. 3 is a conceptual diagram showing the internal structure of the banknote settlement machine 2*a* forming part of the cash settlement device 2. The banknote settlement machine 2*a* includes an inlet cover 211*a*. When depositing money, a salesclerk (or a customer) opens the inlet cover 211*a* to place one or more banknotes into an inlet 210*a*. The inlet 210*a* is configured to feed the placed banknote(s) one by one to a transport unit 230*a*. The transport unit 230*a* is configured to pass the fed banknote through a recognition unit 240*a* and then to transport the banknote to a storage unit 250*a*, the cash transport cassette 30, or an outlet 220*a*. The recognition unit 240*a* determines the denomination, authentication, fitness, series, number, and other features of the banknote being transported. The transport unit 230*a* allows the banknotes to be stored in the storage unit 250*a* on a denomination-by-denomination basis, based on what the recognition unit 240*a* determines.

To dispense banknotes, the storage unit 250*a* is configured to feed banknotes one by one to the transport unit 230*a*. The transport unit 230*a* transports the fed banknotes to the outlet 220*a*. The banknote settlement machine 2*a* includes an outlet shutter 221*a*. When money is dispensed, the outlet shutter 221*a* is opened to dispense one or more banknotes.

As can be seen, the banknote settlement machine 2*a* can store, in the storage unit 250*a*, the banknotes placed into the inlet 210*a*, and can dispense the banknotes stored in the storage unit 250*a* to the outlet 220*a*. That is to say, the banknote settlement machine 2*a* is configured to be able to reuse the deposited banknotes as banknotes to be dispensed.

The banknote settlement machine 2*a* is provided with a cassette fitting portion 260*a* into which the cash transport cassette 30 is detachably fitted. If the cash transport cassette 30 is fitted into the cassette fitting portion 260*a*, the banknote settlement machine 2*a* can load banknotes from the cash transport cassette 30 into the storage unit 250*a*, or collect banknotes from the storage unit 250*a* to transfer the collected banknotes to the cash transport cassette 30. If banknotes are loaded into the banknote settlement machine 2*a* (for example, if, as described below, the banknote settlement machine 2*a* is replenished with change funds), the cash transport cassette 30 feeds the banknotes one by one to the transport unit 230*a*. The transport unit 230*a* loads the fed banknotes into the storage unit 250*a*. If banknotes are collected from the banknote settlement machine 2*a*, the storage unit 250*a* feeds the banknotes one by one to the transport unit 230*a*. The transport unit 230*a* feeds the fed banknotes to the cash transport cassette 30 to collect these banknotes.

As can be seen, the banknote settlement machine 2*a* is configured to be able to load and collect banknotes using the cash transport cassette 30.

Figure 4:
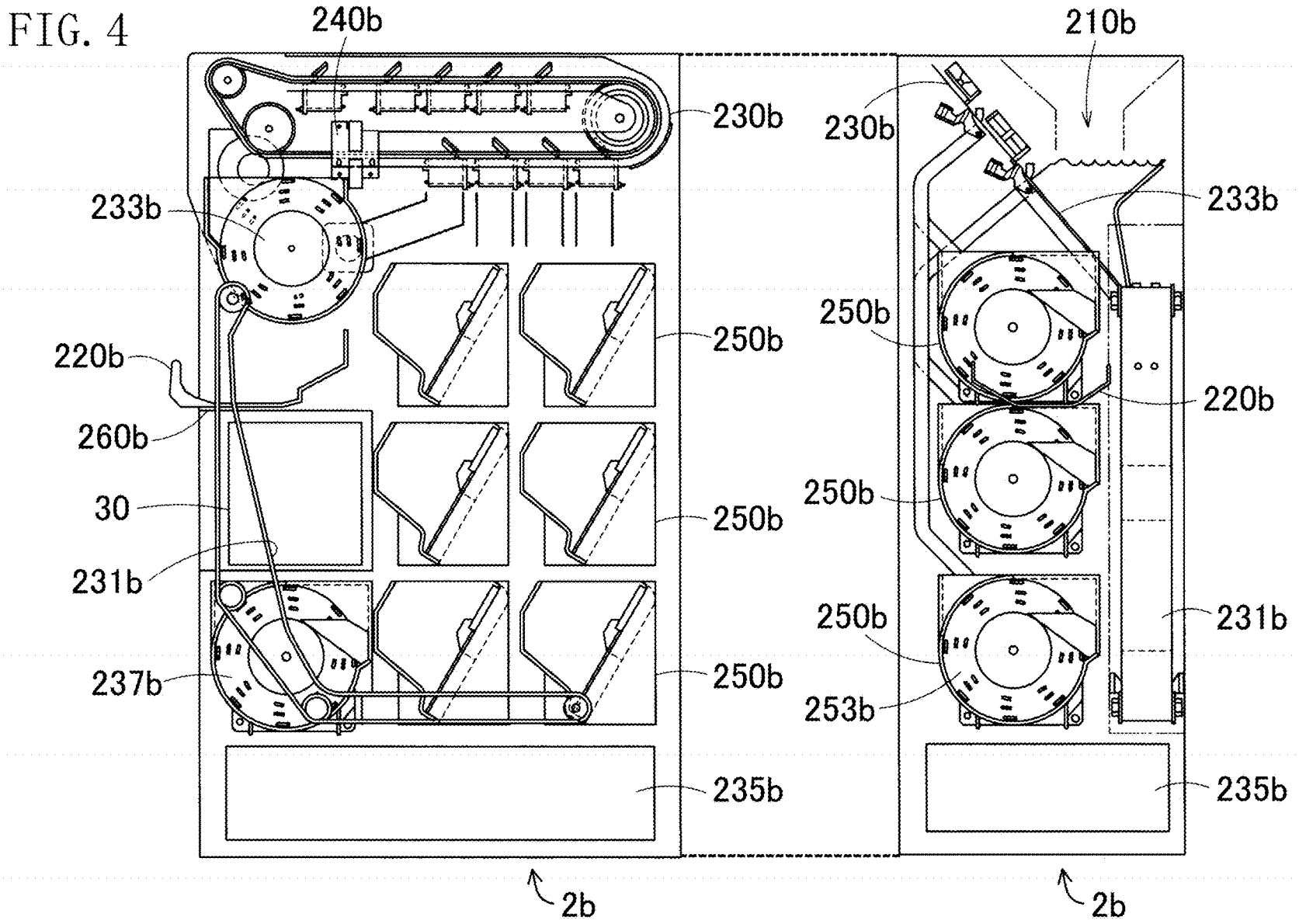
FIG. 4 is a conceptual diagram showing an internal structure of a coin settlement machine.

FIG. 4 is a conceptual diagram showing the internal structure of the coin settlement machine 2*b* forming part of the cash settlement device 2. A left portion of FIG. 4 is a cross-sectional view of the coin settlement machine 2*b* as viewed from the side, and a right portion of FIG. 4 is a cross-sectional view of the coin settlement machine 2*b* as viewed from the front. In the right portion of FIG. 4, a cash transport cassette 30 and a feeder 237*b* are not illustrated, and storage units 250*b* are illustrated.

The coin settlement machine 2*b* includes an inlet 210*b*, and a salesclerk (or a customer) drops coins into the inlet 210*b* when depositing money. At this time, a plurality of denominations of coins may be dropped in a mixed state. A disc-shaped feeder 233*b* is configured to feed the coins dropped into the inlet 210*b* one by one to a transport unit 230*b*. The transport unit 230*b* passes the fed coins through a recognition unit 240*b* and then transports the coins to one of the storage units 250*b*, the cash transport cassette 30, or an outlet 220*b*. The recognition unit 240*b* determines the denomination, authentication, fitness, series, number, and other features of the coin being transported. The transport unit 230*b* sorts coins by denomination based on what the recognition unit 240*b* determines, and allows the coins to be each stored in one of the storage units 250*b* for an associated one of denominations.

To dispense coins, the storage units 250*b* are each configured to feed coins one by one to a transport unit 231*b*. The storage units 250*b* store cash by denomination, and each include a disc-shaped feeder 253*b*. The feeder 253*b* is configured to feed coins one by one to the transport unit 231*b*. The transport unit 231*b* transports the fed coins to the outlet 220*b*. As a result, the coin settlement machine 2*b* dispenses the coins to the outlet 220*b*.

As can be seen, the coin settlement machine 2*b* can store the coins dropped into the inlet 210*b* in the associated storage units 250*b*, and can dispense the coins stored in the storage unit 250*b* to the outlet 220*a*. That is to say, the coin settlement machine 2*b* is configured to be able to reuse the deposited coins as coins to be dispensed.

If the cash transport cassette 30 is fitted into the cassette fitting portion 260*b*, the coin settlement machine 2*b* can load coins from the cash transport cassette 30 into the associated storage units 250*b*, or collect coins from any one of the storage units 250*a* to feed the collected coins to the cash transport cassette 30*b*. If coins are loaded into the coin settlement machine 2*b* (for example, if, as described below, the coin settlement machine 2*b* is replenished with change funds), the cash transport cassette 30 dispenses the coins to the feeder 237*b* shown in the left portion of FIG. 4. At this time, the cash transport cassette 30 may dispense different denominations of coins to the feeder 237*b*. The feeder 237*b* feeds the coins to the transport unit 231*b*. The transport unit 231*b* transports the fed coins to the feeder 233*b*, which feeds the coins one by one to the transport unit 230*b*. The transport unit 230*b* is configured to pass the fed coins through the recognition unit 240*b* and then to transport the coins to the associated storage units 250*b* or the outlet 220*b*. The recognition unit 240*b* determines the denominations of the coins being transported. The transport unit 230*b* allows coins to be stored in the storage units 250*b* on a denomination-by-denomination basis, based on what the recognition unit 240*b* determines.

If coins are collected from the coin settlement machine 2*b*, the coin settlement machine 2*b* feeds coins one by one from the storage units 250*b* to the transport unit 231*b*. The transport unit 231*b* feeds the fed coins to the cash transport cassette 30 to collect these coins.

As can be seen, the coin settlement machine 2*b* is configured to be able to load and collect coins using the cash transport cassette 30.

Figure 5:
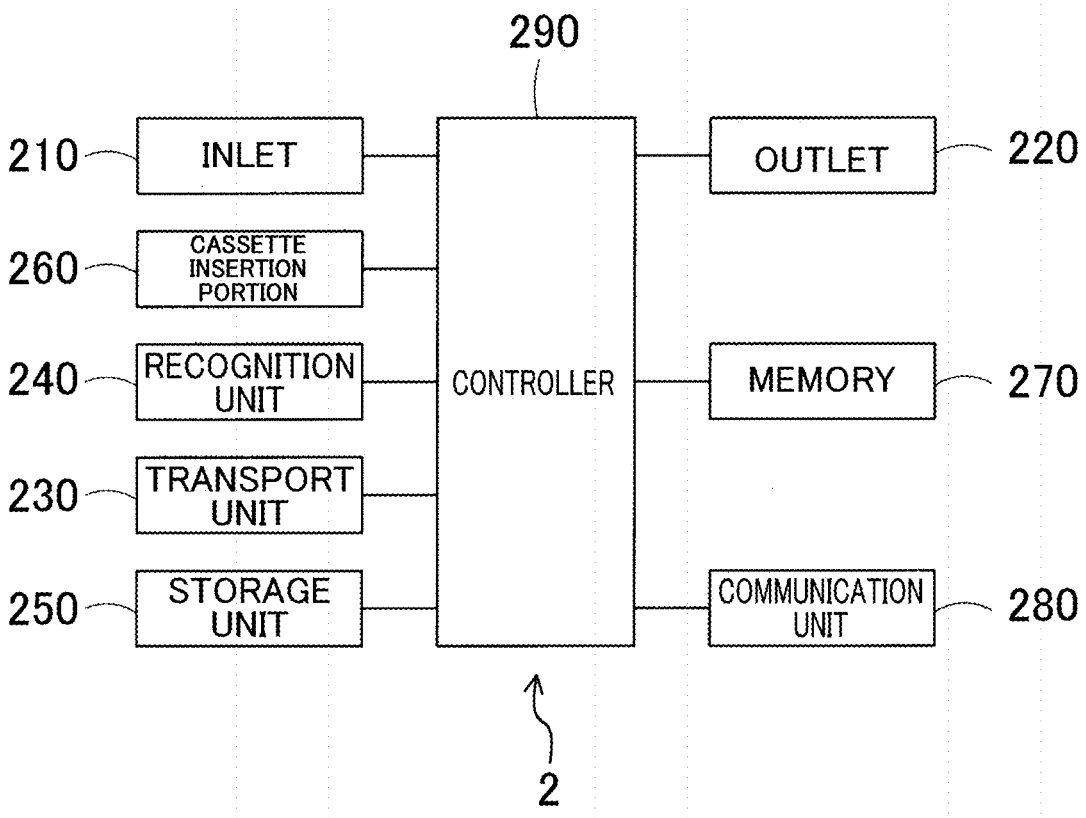
FIG. 5 is a block diagram showing a configuration of a cash settlement device.

FIG. 5 is a block diagram showing a configuration of each cash settlement device 2 including the banknote settlement machine 2*a*, the coin settlement machine 2*b*, and the control box 2*c* described above. The reference characters without "a" and "b" are used to represent components common between the banknote settlement machine 2*a* and the coin settlement machine 2*b*. This block diagram mainly shows components related to control on replenishment of the cash settlement device 2 with change funds, which will be described below, as components of the cash settlement device 2.

The cash settlement device 2 further includes a memory 270, a communication unit 280, and a controller 290 in addition to the inlets 210, the outlets 220, the transport units 230, the recognition units 240, the storage units 250, and the cassette fitting portions 260 described above.

The memory 270 includes a ROM or an HDD storing data and various programs that control the cash settlement device 2, and a RAM serving as an area where a program is loaded or a work area during the execution of a program. The memory 270 further stores information on cash stored in each of the storage units 250 and the cash transport cassettes 30 (such as denominations and quantity). Furthermore, the memory 270 may store the quantity of each denomination of cash determined by an associated one of the recognition units 240.

The communication unit 280 is communicably connected to the other devices forming part of the cash management system 1 (the cashier device 5, the cash management device 6, and the POS management device 7) and the register 40.

The controller 290 is an arithmetic processing unit configured to execute a program in the memory 270 to control the entire cash settlement device 2.

The controller 290 calculates the amount of cash placed into each inlet 210 based on the results obtained by the recognition unit 240 determining banknotes or coins and counting banknotes or coins. The controller 290 receives, from the register 40, information manually entered into the register 40 and corresponding to at least one part of a deposit from a customer (hereinafter referred to as manually input information) via the communication unit 280, and calculates the total amount of the deposit from the customer.

Furthermore, the controller 290 receives the total price of commercial products purchased by the customer from the register 40 via the communication unit 280, and calculates the amount of change by subtracting the total price of the purchased commercial products from the total amount of the deposit from the customer. Then, the controller 290 controls components of the cash settlement device 2 to dispense the calculated amount of the change.

The controller 290 can output, to the cash management device 6, the calculated amount of cash placed and manually input information received from the register 40 with the calculated amount of cash and the information distinguished from each other. Thus, the cash management apparatus 6 can manage the amount of cash actually stored in the cash settlement device 2 and the amount of cash (for example, rejected cash) which is not stored in the cash settlement device 2 but has been deposited, with these amounts distinguished from each other.

The controller 290 can output, to the cash management device 6, information on the inventory number of banknotes or coins as change funds in the cash settlement device 2 on a denomination-by-denomination basis. The controller 290 may determine whether or not the inventory number of each denomination of banknotes or coins as change funds is equal to or less than a preset nearly empty value, and may also output information on this determination to the cash management device 6.

Figure 6:
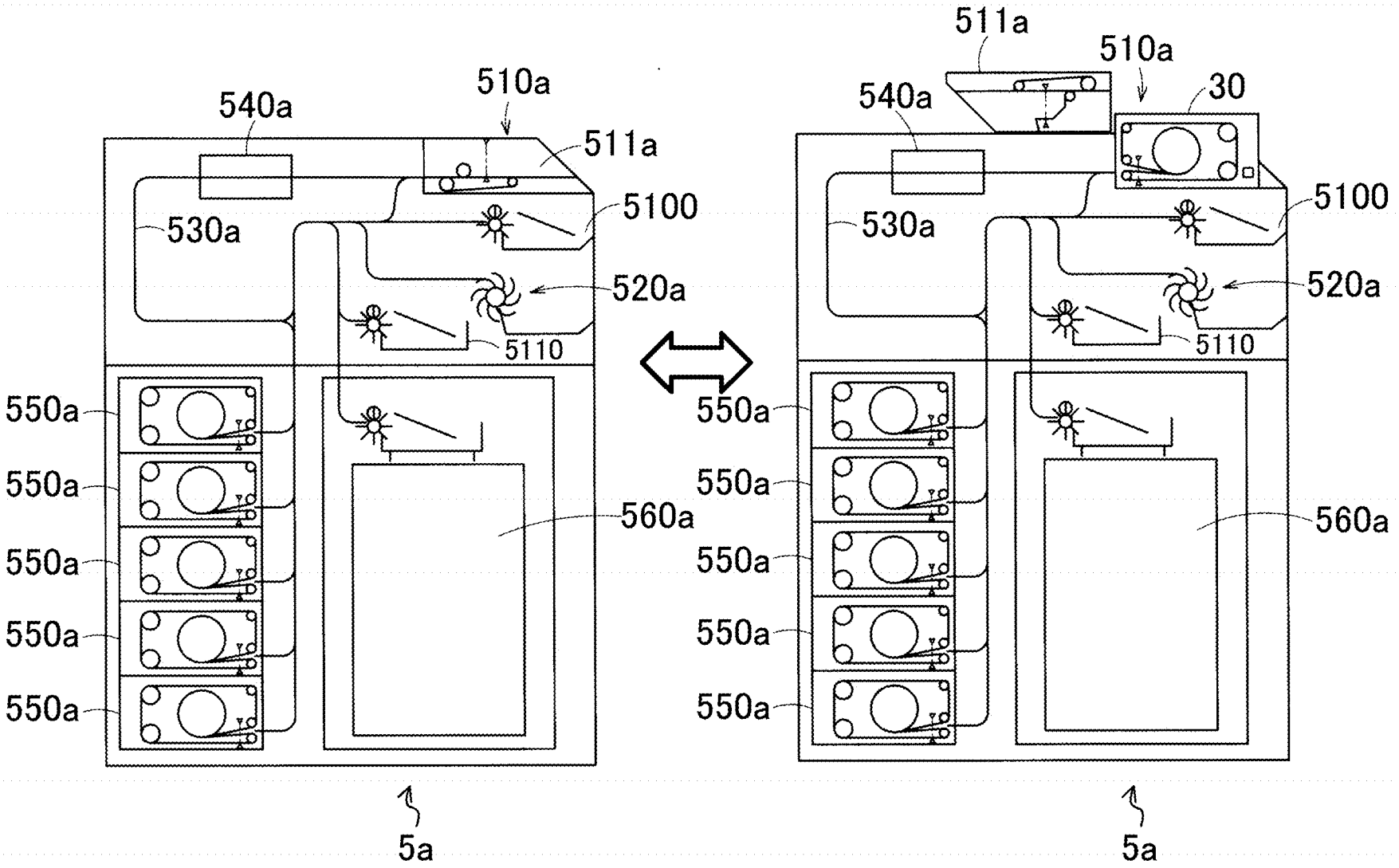
FIG. 6 is a conceptual diagram showing an internal structure of a banknote cashier machine. A left portion of FIG. 6 shows a state where a banknote receiving unit is fitted to the banknote cashier machine, and a right portion of FIG. 6 shows a state where a cash transport cassette is fitted to the banknote cashier machine.

FIG. 6 is a conceptual diagram showing the internal structure of the banknote cashier machine 5*a* forming part of the cashier device 5. A left portion of FIG. 6 shows a state where a banknote receiving unit 511*a* is fitted into an inlet 510*a*, and a right portion of FIG. 6 shows a state where a cash transport cassette 30 is fitted into the inlet 510*a*.

As shown in the left portion of FIG. 6, the banknote receiving unit 511*a* is detachably fitted into the inlet 510*a* of the banknote cashier machine 5*a*. The banknote receiving unit 511*a* is configured to receive banknotes from the outside of the banknote cashier machine 5*a* and feed the banknotes one by one to the transport unit 530*a* while being fitted into the inlet 510*a*. The banknote receiving unit 511*a* is used if a salesclerk manually deposits banknotes into the banknote cashier machine 5*a*.

As shown in the right portion of FIG. 6, instead of the banknote receiving unit 511*a*, the cash transport cassette 30 may be fitted into the inlet 510*a*. If the cash transport cassette 30 is fitted, banknotes are fed one by one from the cash transport cassette 30 to the transport unit 530*a*. Note that banknotes may be stored in the cash transport cassette 30 fitted into the inlet 510*a* as described below.

The transport unit 530*a* is configured to pass the fed banknotes through the recognition unit 540*a* and then to transport the banknotes to associated storage units 550*a*, a collector 560*a*, an external reject unit 5100, or an internal reject unit 5110.

The recognition unit 540*a* determines the denomination, authentication, fitness, series, number, and other features of the banknote being transported. The transport unit 530*a* allows the banknotes to be stored in the storage units 550*a* on a denomination-by-denomination basis, based on what the recognition unit 540*a* determines.

To dispense banknotes, the storage units 550*a* are each configured to feed the stored banknotes one by one to the transport unit 530*a*. The transport unit 530*a* transports the fed banknotes to the outlet 520*a*, the cash transport cassette 30 fitted into the inlet 510*a*, or the collector 560*a*. The banknotes to be dispensed from the banknote cashier machine 5*a* are sent to the outlet 520*a* or the cash transport cassette 30 as change funds that will be described below.

The collector 560*a* is used to collect the banknotes stored in the storage units 550*a*. A banknote storage bag (not shown) for storing banknotes is detachably fitted to the collector 560*a*. The banknotes sent from the storage units 550*a* to the collector 560*a* via the transport unit 530*a* are stored in the banknote storage bag. A denomination of banknotes that are not assigned to any one of the storage units 550*a* and overflow banknotes that cannot be stored in one of the storage units 550*a* for the corresponding denomination of banknotes due to fullness of the one of the storage units 550*a* are also stored in the banknote storage bag of the collector 560*a*. Removing the banknote storage bag from the collector 560*a* allows the banknotes to be collected from the banknote cashier machine 5*a* together with the banknote storage bag.

A banknote that has been determined by the recognition unit 540*a* to be abnormal is sent, as a rejected banknote, to the external reject unit 5100. On the other hand, a rejected banknote that cannot be dispensed to the outside of the banknote cashier machine 5*a* is sent to the internal reject unit 5110, which stores the rejected banknote. Only an operator having administrative authority can access banknotes in the internal reject unit 5110.

As can be seen, the banknote cashier machine 5*a* can store, in the storage units 550*a*, banknotes placed into the inlet 510*a*, and can dispense the banknotes stored in the storage units 550*a* to the outlet 520*a* or load the banknotes into the cash transport cassette 30. That is to say, the banknote cashier machine 5*a* is configured to be able to reuse the deposited banknotes as banknotes to be dispensed.

When the proceeds from sales of each register 40 are deposited into the banknote cashier machine 5*a*, banknotes are sent into the banknote cashier machine 5*a* through the banknote receiving unit 511*a* or the cash transport cassette 30 as described above. The sent banknotes are stored in the storage units 550*a*. On the other hand, when change funds are dispensed, the banknotes fed from the storage units 550*a* are dispensed to the outlet 520*a* or loaded into the cash transport cassette 30.

Figure 7A:
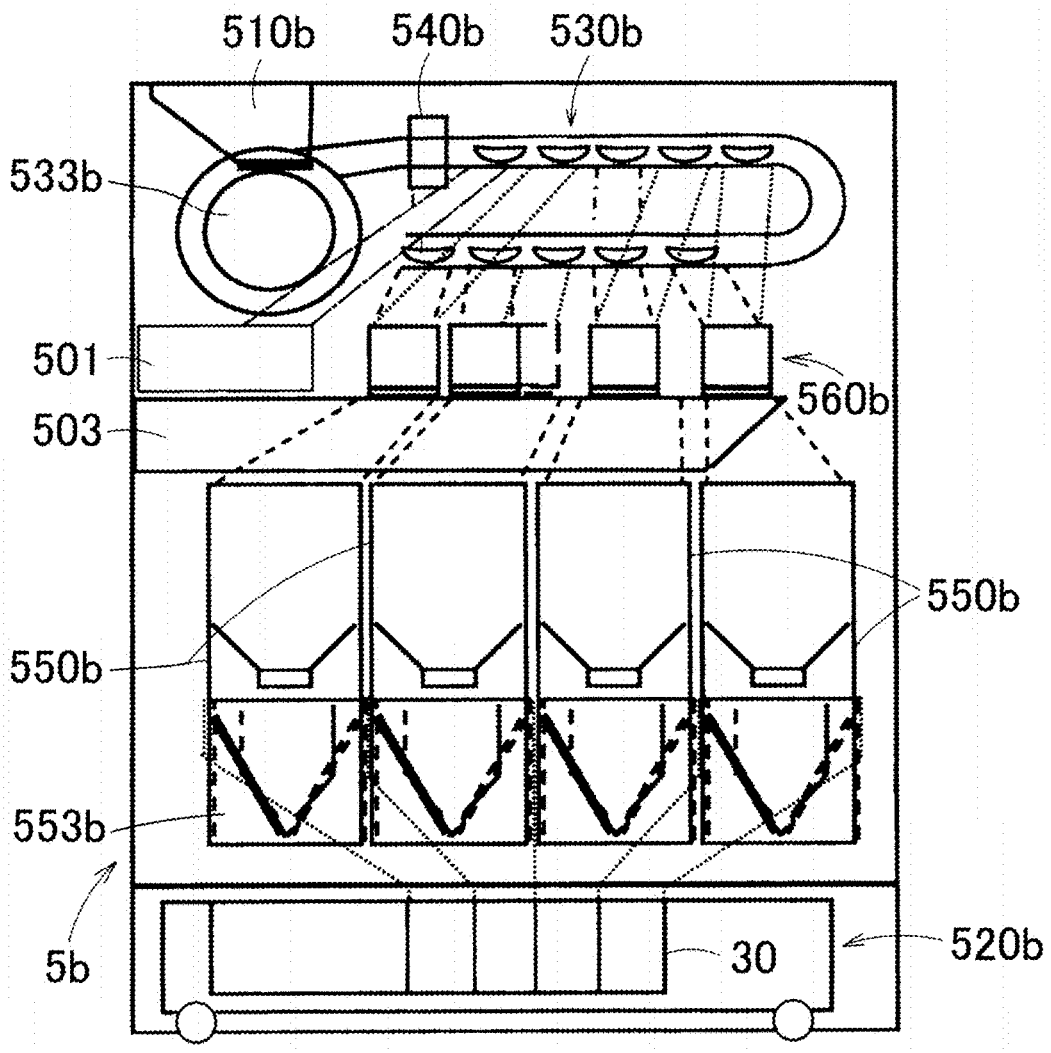
FIG. 7A is a conceptual diagram of an internal structure of a coin cashier machine as viewed from the side.
Figure 7B:
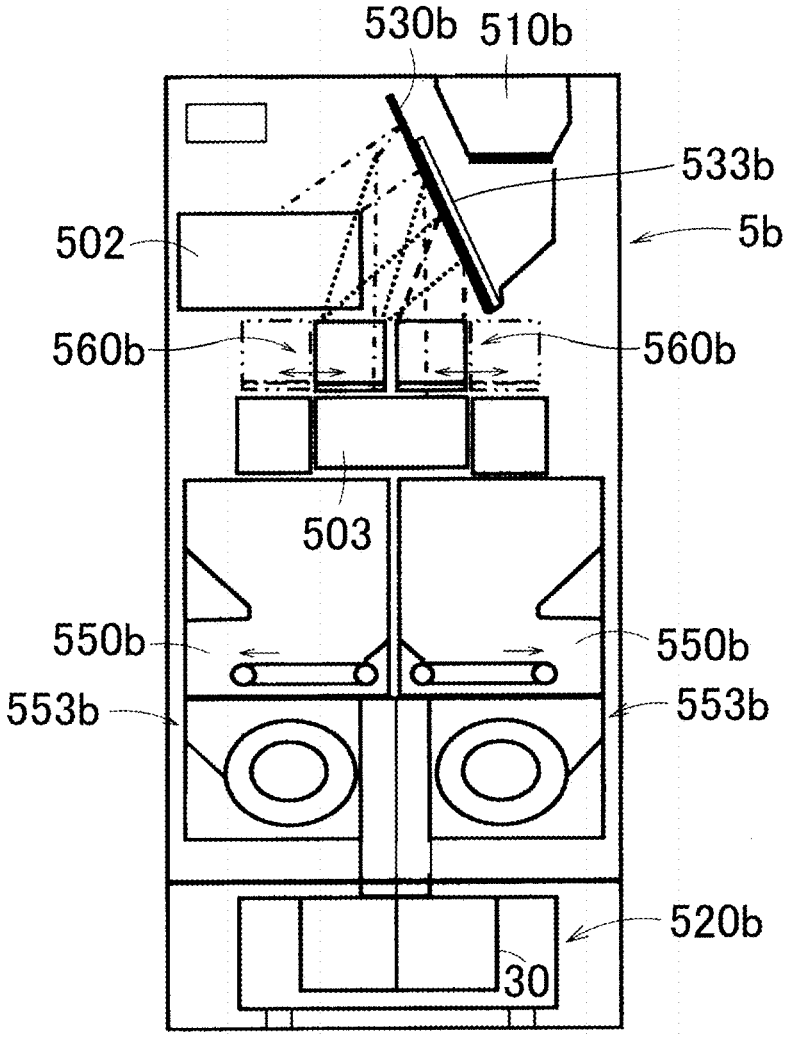
FIG. 7B is a conceptual diagram of the internal structure of the coin cashier machine as viewed from the front.

FIGS. 7A and 7B are conceptual diagrams showing the internal structure of the coin cashier machine 5*b* forming part of the cashier device 5. FIG. 7A illustrates the internal configuration of the coin cashier machine 5*b* as viewed from the side, and FIG. 7B shows the internal configuration of the coin cashier machine 5*b* as viewed from the front.

The coin cashier machine 5*b* includes an inlet 510*b*. Coins to be deposited into the coin cashier machine 5*b* are dropped into the inlet 510*b*. At this time, a plurality of denominations of coins may be dropped in a mixed state. A disc-shaped feeder 533*b* is configured to feed the coins dropped into the inlet 510*b* one by one to a transport unit 530*b*.

The transport unit 530*b* passes coins through a recognition unit 540*b* and then transports the coins to temporary storage units 560*b*, a reject unit 501, or an overflow box 502. The recognition unit 540*b* determines the denominations, authentication, fitness, series, number, and other features of the coins being transported. The transport unit 530*b* sorts the coins by denomination and allows the coins to be stored in one of the temporary storage units 560*b* for the corresponding denomination.

A plurality of storage units 550*b* are provided below the temporary storage units 560*b*. The temporary storage units 560*b* each send the corresponding denomination of coins stored to a return box 503 or each send the corresponding denomination of coins stored to an associated one of the storage units 550*b* through an associated chute. The return box 503 is configured to be capable of being pulled out to the outside of the coin cashier machine 5*b*. The coins sent to the return box 503 are returned by being pulled out to the outside of the coin cashier machine 5*b*.

The storage units 550*b* each store an associated denomination of coins. To dispense coins, the storage units 550*b* each include a disc-shaped feeder 553*b*. The feeder 553*b* is configured to feed coins one by one.

A collection box (outlet) 520*b* is provided below the storage units 550*b*. The cash transport cassettes 30 are detachably provided in the collection box 520*b*. The storage units 550*b* are respectively connected to the cash transport cassettes 30 through individual chutes. The coins fed from each storage unit 550*b* are stored in an associated one of the cash transport cassettes 30 placed in the collection box 520*b* while being sorted by denomination. The collection box 520*b* is configured to be capable of being pulled forward of the coin cashier machine 5*b* from a lower portion of the front surface of the coin cashier machine 5*b*.

As can be seen, the coin cashier machine 5*b* can store, in the storage units 550*b*, the coins dropped into the inlet 510*b*, and can dispense the coins stored in the storage units 550*b* to the associated cash transport cassettes 30. That is to say, the coin cashier machine 5*b* is configured to be able to reuse the deposited coins as coins to be dispensed.

When the proceeds from sales of each register 40 are deposited into the coin cashier machine 5*b*, coins are dropped into the inlet 510*b*, and the dropped coins are stored in the storage units 550*b*, as described above. On the other hand, when change funds are dispensed, coins fed from the storage units 550*b* are dispensed to the cash transport cassette 30 attached to the collection box 520*b*.

Figure 8:
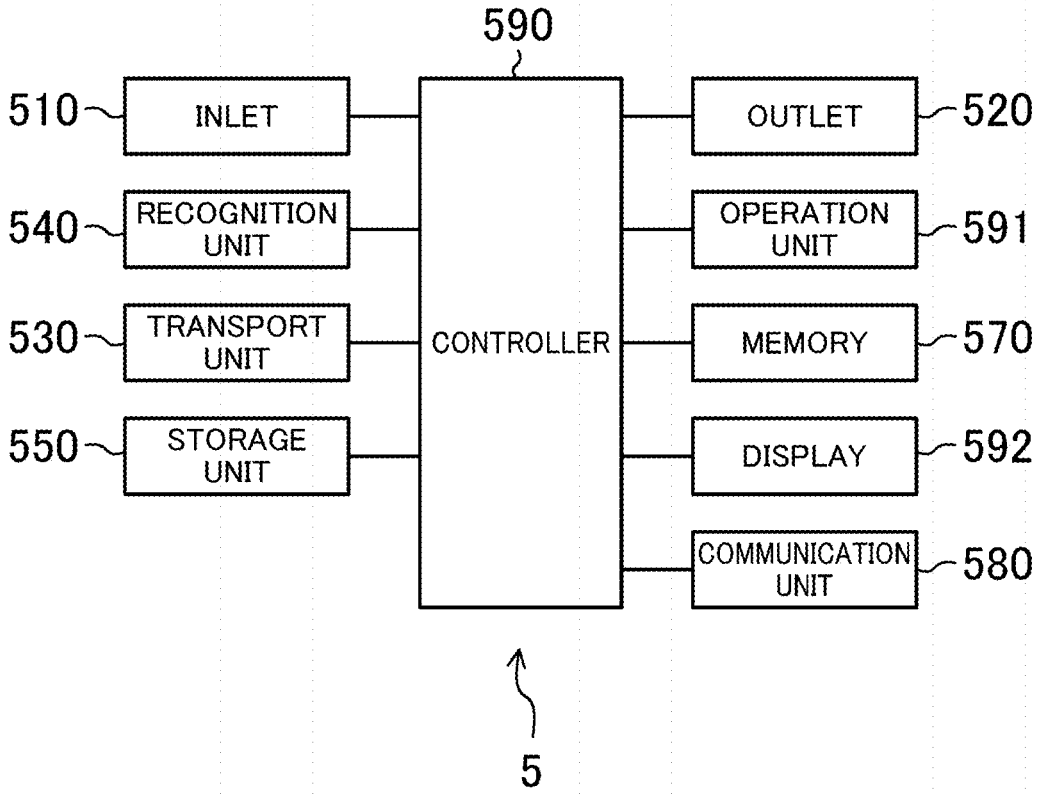
FIG. 8 is a block diagram showing a configuration of a cashier device.

FIG. 8 is a block diagram showing a configuration of the cashier device 5. The reference characters without "a" and "b" are used to represent components common between the banknote cashier machine 5*a* and the coin cashier machine 5*b*. This block diagram mainly shows components related to control on replenishment of the cash settlement device 2 with change funds, which will be described below, as components of the cashier device 5.

The cashier device 5 further includes a memory 570, a communication unit 580, a controller 590, an operation unit 591, and a display 592 in addition to the inlets 510, the outlets (or the collection box) 520, the transport units 530, the recognition units 540, and the storage units 550 described above.

The memory 570 includes a ROM or an HDD storing data and various programs that control the cashier device 5, and a RAM serving as an area where a program is loaded or a work area during the execution of a program. The memory 570 further stores information on cash stored in each of the storage units 550 and the cash transport cassettes 30 (such as denominations and quantity). Furthermore, the memory 570 may store the quantity of each denomination of cash determined by an associated one of the recognition units 540.

The communication unit 580 is communicably connected to the other devices forming part of the cash management system 1 (the cash settlement devices 2, the cash management device 6, and the POS management device 7).

The controller 590 is an arithmetic processing unit configured to execute a program in the memory 570 to control the entire cashier device 5.

The controller 590 calculates the amount of cash placed into each inlet 510 based on the results obtained by the recognition unit 540 determining banknotes or coins and counting banknotes or coins.

Although described below in detail, the controller 590 can output, to the cash management device 6, information on the internal inventory number of banknotes or coins that can be dispensed as change funds when receiving a request to supply change funds.

As described below in detail, the controller 590 dispenses banknotes and/or coins serving as change funds in accordance with instructions from the cash management device 6 when receiving a request to supply change funds.

As described below in detail, a person in charge of a shop, for example, operates the operation unit 591 when making a request to supply change funds. Although not shown in detail, the operation unit 591 includes an authentication unit (such as a card reader) for authenticating a person who operates the cashier device 5. The operation unit 591 further includes a hardware keyboard through which an input operation is performed. The display 592 may be configured as a touch panel display 592 without providing the hardware keyboard, and the operation unit 591 and the display 592 may be integrated together.

The display 592 displays various types of information for an operator who operates the cashier device 5.

Figure 9:
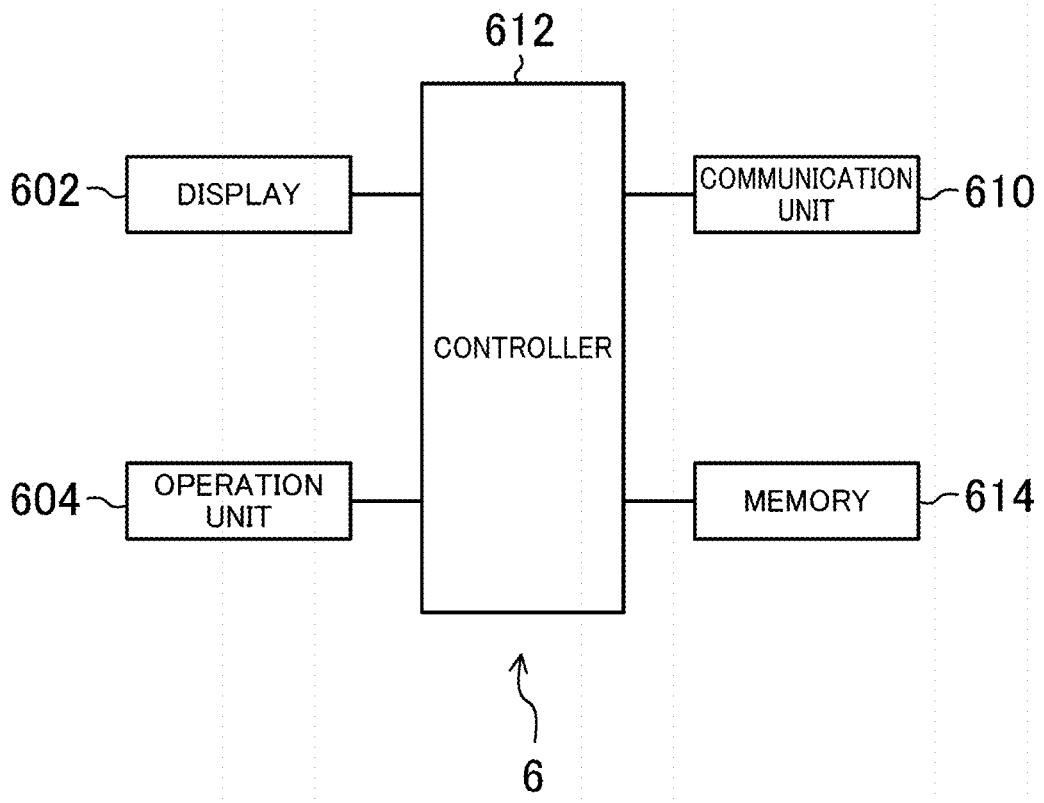
FIG. 9 is a block diagram showing a configuration of a cash management device.

FIG. 9 is a block diagram showing a configuration of the cash management device 6. The cash management device 6 includes a display 602, an operation unit 604, a communication unit 610, a controller 612, and a memory 614. The display 602 displays various types of information. The operation unit 604 includes a keyboard and a pointing device, and is used by a person in charge to perform various operations. The communication unit 610 communicates with the cash settlement devices 2, the cashier device 5, and the POS management device 7.

The memory 614 includes a ROM or an HDD storing data and various programs that control the cash management device 6, and a RAM serving as an area where a program is loaded or a work area during the execution of a program. Furthermore, as described below, the memory 614 stores information on the post-replenishment inventory number of banknotes or coins in each cash settlement device 2. The information serves as a standard referred to when the cash settlement device 2 is replenished with change funds. The post-replenishment inventory number of banknotes or coins corresponds to the inventory number of banknotes or coins as change funds in the cash settlement device 2 that has been replenished with change funds. Note that each cash settlement device 2 may store information on the post-replenishment inventory number of banknotes or coins in the memory 270, and the controller 290 of the cash settlement device 2 may output information on the post-replenishment inventory number of banknotes or coins to the cash management device 6.

The controller 612 is an arithmetic processing unit configured to execute a program in the memory 614 to control the entire cash management device 6. The controller 612 manages the inventory number of banknotes or coins in each cash settlement device 2 of the cash management system 1 and the inventory number of banknotes or coins in the cashier device 5 on a denomination-by-denomination basis. These inventory numbers have been acquired through the communication line 12 and the communication unit 610.

(Description of Process for Supplying Change Funds)

A process for supplying change funds in the cash management system 1 will now be described in detail. First, principal steps of the process for supplying change funds will now be described. If the amount of change funds stored in a cash settlement device 2 is small during the business hours of the shop, the cash settlement device 2 needs to be replenished with change funds. The reference inventory number of each denomination of banknotes or coins as change funds (a nearly empty value) may be determined in advance. When the inventory number of the denomination of banknotes or coins as change funds decreases to the nearly empty value, the cash settlement device 2 may inform a person in charge that the cash settlement device 2 needs to be replenished with change funds.

The person in charge operates the cashier device 5 in the back office 11 to supply change funds. Specifically, the person in charge first uses the cashier device to perform an authentication operation using, for example, an ID card. In response to the authentication operation, the cashier device 5 determines whether or not the operator has authority concerning an operation for supplying change funds, and determines one of the cash settlement devices 2 of the cash management system 1 to be replenished with change funds. The person in charge may perform an operation to designate one of the cash settlement devices 2 to be replenished with change funds.

The cash management device 6 controls how the cashier device 5 dispenses change funds. If, after completion of the authentication process, the person in charge operates the cashier device 5 to make a request to supply change funds, the cashier device 5 transmits a signal indicating the request via the communication line 12 to the cash management apparatus 6.

The cash management device 6 previously stores information on the post-replenishment inventory number of banknotes or coins in each cash settlement device 2 on a denomination-by-denomination basis as described above. The information serves as a standard referred to when the cash settlement device 2 is replenished with change funds. The post-replenishment inventory number corresponds to the inventory number of banknotes or coins as change funds in the cash settlement device 2 that has been replenished with change funds, and is determined for each cash settlement device 2 or in common for the cash settlement devices 2 in the cash management system 1.

When a request is made to replenish a cash settlement device 2 with change funds, the cash management device 6 acquires the inventory number of a concerned denomination of banknotes or coins as change funds in the cash settlement device 2 to be replenished, and checks the post-replenishment inventory number of the denomination of banknotes or coins. This post-replenishment inventory number is determined for the cash settlement device 2 to be replenished. The cash management device 6 calculates the shortage of change funds corresponding to the difference between the inventory number of banknotes or coins as change funds and the post-replenishment inventory number thereof. The cash management device 6 instructs the cashier device 5 via the communication line 12 to dispense cash equal in amount to the shortage. The cashier device 5 receives the instruction to dispense cash as change funds. Cash is stored in the cash transport cassette 30 fitted into the cashier device 5, for example. The person in charge removes the cash transport cassette 30 from the cashier device 5, and carries the cash transport cassette 30 to one of the checkout counters 10 to fit the cash transport cassette 30 into the cash settlement device 2. As described above, cash in the cash transport cassette 30 is stored, as change funds, in the cash settlement device 2.

If the inventory number of banknotes or coins as cash for change funds in the cashier device 5 is sufficiently high, every time a request is made to replenish a target cash settlement device 2 with change funds, the cash management device 6 instructs the cashier device 5 to dispense such an amount of cash that allows the inventory number of a denomination of cash associated with the request in the target cash settlement device 2 to be equal to the post-replenishment inventory number as described above. However, suppose that, every time a request is made to supply change funds, the cashier device 5 dispenses such an amount of cash that allows the inventory number of a denomination of banknotes or coins associated with the request to be equal to the post-replenishment inventory number while the inventory number of banknotes or coins as cash for change funds is low. In that case, change funds would lack. Even if a request is subsequently made to supply change funds, a sufficient amount of cash may be prevented from being dispensed, or cash may be prevented from being dispensed.

To address such a problem, if the inventory number of banknotes or coins as cash for change funds in the cashier device 5 is low, the cash management system 1 according to the present disclosure limits the amount of change funds dispensed. Specifically, when a request is made to supply change funds, the cash management device 6 acquires not only the inventory number of banknotes or coins in the target cash settlement device 2 to be replenished, but also the inventory number of a concerned denomination of banknotes or coins in each cash settlement device 2 of the cash management system 1. Then, the number of banknotes or coins lacking relative to the post-replenishment inventory number of banknotes or coins in each cash settlement device 2 is calculated, and the sum of these numbers is calculated. The sum of these numbers corresponds to the total number of banknotes or coins lacking in the cash settlement devices 2 of the cash management system 1.

If the cash management device 6 compares the calculated sum of the numbers with the inventory number of banknotes or coins in the cashier device 5, and as a result, the inventory number of banknotes or coins in the cashier device 5 is equal to the calculated sum, or the inventory number of banknotes or coins in the cashier device 5 is higher than the calculated sum, a determination is made that the inventory number of banknotes or coins in the cashier device 5 is sufficiently high. Thus, as described above, in response to a request to supply change funds, an amount of cash that allows the inventory number of banknotes or coins to be equal to the post-replenishment inventory number is dispensed. On the other hand, if the inventory number of banknotes or coins in the cashier device 5 is lower than the calculated sum, a determination is made that the inventory number of banknotes or coins in the cashier device 5 is low. Thus, the amount of change funds dispensed is limited.

When the amount of cash dispensed is limited, a specific amount of cash dispensed is calculated by apportioning the inventory number of banknotes or coins in the cashier device 5 based on the ratios of the numbers of banknotes or coins lacking in the cash settlement devices 2 to the calculated sum. This allows an amount of change funds matching the number of banknotes or coins lacking in one of the cash settlement devices 2 associated with the request to be dispensed to the cash settlement device 2 even while the amount of cash dispensed is limited. Apportionment of change funds will now be described with a specific example. In the following specific example, first to fourth four registers 40 are provided in the cash management system 1, and first to fourth four cash settlement devices 2 are provided to correspond to the first to fourth registers 40, respectively.

FIG. 10 is a table for explaining a first apportionment example. In this first apportionment example, change funds are prepared as 10-euro banknotes. In the first apportionment example, each of the first to fourth cash settlement devices 2 stores ten 10-euro banknotes as its default. The cashier device 5 stores ten 10-euro banknotes. As a result of repeating deposit and dispensing of 10-euro banknotes from this initial state, the inventory numbers of 10-euro banknotes in the first, second, third, and fourth cash settlement devices 2 decrease to two, six, six, and eight, respectively. In that case, the cashier device 5 still stores the ten 10-euro banknotes.

If the nearly empty value of each of the first to fourth cash settlement devices 2 is set to be three, the inventory number of banknotes or coins in the first cash settlement device 2 is below the nearly empty value. Thus, the first cash settlement device 2 needs to be replenished with 10-euro banknotes. A person in charge, therefore, requests the cashier device 5 to replenish the first cash settlement device 2 with change funds prepared as 10-euro banknotes.

When the replenishment request is made, the cash management device 6 acquires the inventory number of a denomination of banknotes or coins in each of the first to fourth cash settlement devices 2. As described above, when the replenishment request is made, the inventory numbers (A) of banknotes in the first, second, third, and fourth cash settlement devices 2 are two, six, six, and eight, respectively. The post-replenishment inventory number (B) in each of the first to fourth cash settlement devices 2 is determined to be 10. The numbers (C) of banknotes lacking in the first, second, third, and fourth cash settlement devices 2 ((C)=(B)−(A)) are eight, four, four, and two, respectively, and the sum Tc thereof is 18.

The cash management device 6 compares the sum Tc of the numbers of banknotes lacking (18 in this case) with the inventory number Ac of a concerned denomination of banknotes in the cashier device 5 (10 in this case). In this example, since the sum Tc of the numbers of banknotes lacking is greater than the inventory number Ac, the amount of money to be dispensed is limited.

As described above, the cash management device 6 apportions the inventory number (Ac) of banknotes in the cashier device 5 among the cash settlement devices 2 based on the ratios of the numbers (C) of banknotes lacking in the cash settlement devices 2 to the sum (Tc) of the numbers of banknotes lacking. That is to say, Ac×C/Tc is calculated for each cash settlement device 2.

Specifically, in the first apportionment example, the number of banknotes assigned to the first cash settlement device 2 associated with the replenishment request is 10×8/18 (=4). In this case, digits to the right of the decimal point are discarded. As shown in FIG. 10, the numbers of banknotes apportioned into the second, third, and fourth cash settlement devices 2 are two, two, and one, respectively.

Thus, the cashier device 5 dispenses four 10-euro banknotes as change funds for the first cash settlement device 2. Although the inventory number of banknotes in the first cash settlement device 2 does not reach the post-replenishment inventory number therein, the first cash settlement device 2 can be replenished with a certain amount of change funds. If, at this point in time, requests are made to replenish not the first cash settlement device 2 but the second to fourth cash settlement devices 2 with change funds, the numbers of banknotes assigned to the second, third, and fourth cash settlement devices 2 are two, two, and one, respectively. Such an apportionment allows banknotes equal in number to the number of banknotes lacking in each cash settlement device 2 to be dispensed as change funds to the cash settlement device 2. In the first apportionment example, a large amount of change funds can be assigned to the first cash settlement device 2 in which the inventory number of banknotes as change funds is lowest.

As a result of dispensing change funds, the inventory number of banknotes in the cashier device 5 is six. Limiting the number of banknotes to be dispensed allows the inventory number of banknotes in the cashier device 5 to be as high as possible. Thus, the other cash settlement devices 2 can be replenished with change funds also from now on.

FIG. 11 is a table for explaining a second apportionment example showing how change funds are apportioned when supplied. The second apportionment example relates to coins. Each of the first to fourth cash settlement devices 2 stores 150 coins as its default. The cashier device 5 stores 100 coins. The nearly empty value is 20.

In the second apportionment example, since the inventory number (A) of coins in the second cash settlement device 2 has decreased to zero, a request is made to replenish the second cash settlement device 2 with change funds. At this time, the inventory numbers (A) of coins in the first, third, and fourth cash settlement devices 2 are 20, 120, and 162, respectively. The inventory number (Ac) of coins in the cashier device 5 is still 100.

As described above, when a request is made to supply change funds, the cash management device 6 acquires the number (A) of a denomination of coins in each of the first to fourth cash settlement devices 2. The post-replenishment inventory number (B) of coins in each cash settlement device 2 is set to be 150. Thus, the numbers (C) of coins lacking in the first, second, third, and fourth cash settlement devices 2 are 130, 150, 30, and 0, respectively. The inventory number (A) of coins in the fourth cash settlement device 2 at the time of the replenishment request is greater than the post-replenishment inventory number (B) of coins therein. Thus, the number (C) of coins lacking therein is zero. The sum Tc of the numbers of the coins lacking in these cash settlement devices is 310.

The number of coins prepared as change funds and apportioned to the second cash settlement device 2 (Ac×C/Tc) is 48 (=100×150/310). The numbers of coins apportioned to the first, third and fourth cash settlement devices 2 are 41, 9, and 0, respectively. The cashier device 5 dispenses 48 coins as the change funds for the second cash settlement device 2. As a result, the inventory number of coins in the cashier device 5 becomes 52.

FIG. 12 is a table for explaining a third apportionment example showing how change funds are apportioned when supplied. In the third apportionment example, the initial state and the inventory number (A) of coins in each cash settlement device 2 at the time of the replenishment request are the same as those of the second apportionment example. In the third apportionment example, how the number of coins lacking is calculated and how change funds are apportioned into the cash settlement devices 2 are different from those of the second apportionment example. Specifically, one or more targets in each of which the number of coins lacking is to be calculated and to which change funds are apportioned are only one or more of the cash settlement devices 2 in which the inventory number of the corresponding denomination(s) of coins reaches is equal to or less than the nearly empty value. The other cash settlement device(s) 2 in (each of) which the inventory number of the corresponding denomination of coins is above the nearly empty value is determined to be a cash settlement device 2 that does not need to be replenished with change funds, and is thus excluded from the targets. Each cash settlement device 2 or the cash management device 6 may determine whether or not the inventory number of coins in the cash settlement device 2 is equal to or less than the nearly empty value. Note that the nearly empty value is 20 as described above.

In the third apportionment example, when a request is made to supply change funds, the inventory number of coins in each of the first and second cash settlement devices 2 is equal to or less than the nearly empty value, and the inventory number of coins in each of the third and fourth cash settlement devices 2 is above the nearly empty value. Thus, when the number (C) of coins lacking is calculated, the number (C) of coins lacking in each of the first and second cash settlement devices 2 is calculated, and the number (C) of coins lacking in each of the third and fourth cash settlement devices 2 is determined to be zero. Then, the sum Tc of the numbers of coins lacking is calculated, and is compared with the inventory number Ac of coins in the cashier device 5. Also in the third apportionment example, the sum Tc of the numbers of coins lacking (=280≥Ac) is greater than the inventory number Ac of coins in the cashier device 5. Thus, the inventory number of coins in the cashier device 5 is apportioned.

Specifically, in the third apportionment example, the number of coins apportioned to the second cash settlement device 2 is 100×150/280 (=53). As compared with the second apportionment example, in the third apportionment example, excluding one or more cash settlement devices 2 in each of which the inventory number of coins is above the nearly empty value (i.e., one or more cash settlement devices 2 that may be unnecessary to replenished with change funds) from the targets to be replenished can increase the number of coins assigned to the second cash settlement device 2 that needs to be replenished with change funds from 48 to 53.

FIG. 13 is a table for explaining a fourth apportionment example showing how change funds are apportioned when supplied. In the fourth apportionment example, the degree to which each of the registers 40 is busy is taken into account. Specifically, change funds in one of the registers 40 having a high usage frequency are relatively more likely to be lost, while change funds in another one of the registers 40 having a low usage frequency are relatively less likely to be lost. All of the registers in the cash management system 1 are not always used, and some of the registers 40 are not used in some cases (that is, idle registers). In the fourth apportionment example, the degree to which each of the registers 40 is busy is weighted. In the fourth apportionment example, a busyness flag for each cash settlement device 2 is set to be on or off. Specifically, the first, third, and fourth cash settlement devices 2 have their busyness flags turned on. On the other hand, the second cash settlement device 2 has its busyness flag turned off. Each busyness flag is turned on/off at an appropriate timing. For example, when one of the registers 40 is paused during the business hours, the busyness flag of the cash settlement device 2 corresponding to this register 40 may be turned off.

In the fourth apportionment example, the inventory number of coins in the first cash settlement device 2 decreases to 50, and a request is thus made to replenish the first cash settlement device 2 with change funds. The inventory number of coins in the second cash settlement device 2 is zero, while the busyness flag of the second cash settlement device 2 is off. Thus, in the apportionment example shown in FIG. 4, the post-replenishment inventory number of coins in the second cash settlement device 2 is zero. As a result, the number of coins lacking in the second cash settlement device 2 is also zero. The numbers (C) of coins lacking in the first, third, and fourth cash settlement devices 2 are 100, 30, and 0, respectively. The sum Tc of the numbers of coins lacking is 130. Setting the busyness flags allows one of the cash settlement devices 2 that does not need to be replenished to be excluded from targets to be replenished. This can accordingly reduce the sum of the numbers of coins lacking.

As a result, the number of coins apportioned to the first cash settlement device 2 is 100×100/130 (=76). Thus, the number of coins assigned to the first cash settlement device 2 that needs to be replenished can be increased.

FIG. 14 is a table for explaining a fifth apportionment example showing how change funds are apportioned when supplied. In the fourth apportionment example, the busyness flag of each cash settlement device 2 is turned on/off, whereas in the fifth apportionment example, determining the priority order of the cash settlement devices 2 allows the degrees of busyness of the cash settlement devices 2 to be finely set. More specifically, the register 40 of the first cash settlement device 2 is determined to be a busy register, the register 40 of the second cash settlement device 2 is determined to be a normal register, the register 40 of the third cash settlement device 2 is determined to be a slack register, and the register 40 of the fourth cash settlement device 2 is determined to be an inactive register. It can be said that in the fifth apportionment example, the degree to which change funds are required increases in the order of the first, second, third, and fourth cash settlement devices 2.

In the fifth apportionment example, the ratios (r) of change funds apportioned to the cash settlement devices 2 is set so that the degrees to which change funds are apportioned to the first to fourth cash settlement devices 2 vary according to the priority order. Specifically, the ratio r of change funds apportioned to the first cash settlement device 2 serving as a busy register is set to be 150%, the ratio r of change funds apportioned to the second cash settlement device 2 serving as a normal register is set to be 100%, the ratio r of change funds apportioned to the third cash settlement device 2 serving as a slack register is set to be 50%, and the ratio r of change funds apportioned to the fourth cash settlement device 2 serving as an inactive register is set to be 0%. These ratios change the respective post-replenishment inventory numbers of banknotes or coins in the cash settlement devices 2. The reference inventory number (D) of banknotes or coins in each cash settlement device 2 is multiplied by the associated ratio (r) to determine the post-replenishment inventory number (B). Here, the reference inventory number (D) of coins in each of the first to fourth cash settlement devices 2 is set to be 100. The post-replenishment inventory numbers (B) of coins in the first, second, third, and fourth cash settlement devices 2 are 150, 100, 50, and 0, respectively.

In the fifth apportionment example, the inventory number (A) of coins in the first cash settlement device 2 decreases to 10. Thus, a request is made to replenish the first cash settlement device 2 with change funds. At this time, the inventory numbers (A) of coins in the second, third, and fourth cash settlement devices 2 are 20, 100, and 0, respectively. In that case, the inventory number (Ac) of coins in the cashier device 5 is 100.

Accordingly, the numbers (C) of coins lacking in the first, second, third, and fourth cash settlement devices 2 are 140, 80, 0, and 0, respectively. Here, while the inventory number (A) of coins in the fourth cash settlement device 2 is zero, the number (C) of coins lacking is also zero, because the post-replenishment inventory number (B) of coins in the fourth cash settlement device 2 serving as the inactive register is zero. The sum Tc of the numbers of coins lacking is 220.

As a result, the number of coins apportioned to the first cash settlement device 2 is 100×140/220 (=63). This allows a large amount of change funds to be assigned to the first cash settlement device 2 serving as the busy register.

The above-described priority order and the ratios (r) corresponding to the priority order are each set at an appropriate timing. The ratios (r) themselves can be each set to be equal to an appropriate value. These ratios (r) associated with the priority order may be set in accordance with, for example, predicted proceeds from sales and sales achievements (such as yesterday's sales results and sales results on the same day the previous week).

Figure 15:
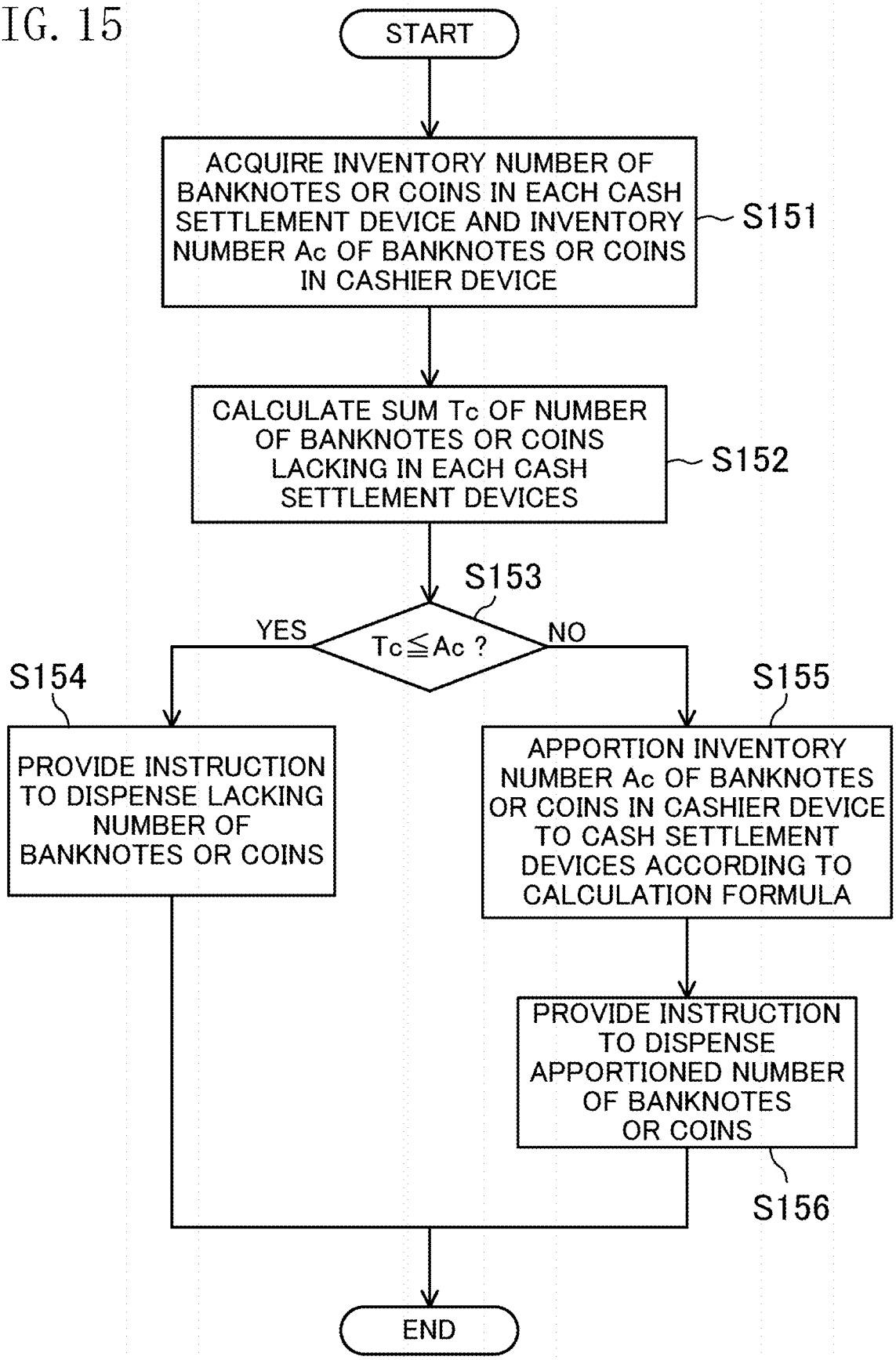
FIG. 15 is a flowchart of control executed by the cash management device when a request is made to supply change funds.

FIG. 15 is a flowchart of control performed by the cash management device 6 when a request is made to supply change funds. As described above, this flow is started, for example, by a person in charge of a shop operating the cashier device 5 to request supply of change funds.

In step S151 after the start, the cash management device 6 acquires the inventory number (A) of a denomination of banknotes or coins associated with the request in each cash settlement device 2 of the cash management system 1 and the inventory number (Ac) of the denomination of banknotes or coins in the cashier device 5. In subsequent step S152, the cash management device 6 calculates the number (C) of banknotes or coins lacking relative to the post-replenishment inventory number (B) in each cash settlement device 2, and calculates the sum (Tc) of the numbers of banknotes or coins lacking. As described above, if the nearly empty value is taken into account, or if the busyness flag or the priority order is set, the cash management device 6 calculates the sum (Tc) of the numbers of banknotes or coins lacking, with the above factors taken into account.

In step S153, a determination is made whether or not the sum (Tc) of the numbers of banknotes or coins lacking is equal to or less than the inventory number (Ac) of banknotes or coins in the cashier device 5. If the sum Tc is equal to or less than the inventory number Ac (i.e., if the determination in step S153 is YES), a determination is made that the inventory number of banknotes or coins in the cashier device 5 is great enough. Thus, the process proceeds to step S154. In step S154, the cash management device 6 instructs the cashier device 5 to dispense an amount of change funds corresponding to the number of banknotes or coins lacking in one of the cash settlement devices 2 associated with the request.

On the other hand, if a determination is made in step S153 that the sum Tc is greater than the inventory number Ac (i.e., if the determination in step S153 is NO), a determination is made that the inventory number of banknotes or coins in the cashier device 5 is low. Thus, the process proceeds to step S155.

In step S155, as described above, the cash management device 6 apportions the inventory number (Ac) of banknotes or coins in the cashier device 5 according to a calculation formula. In subsequent step S156, the cash management device 6 instructs the cashier device 5 to dispense, to the cash settlement device 2 associated with the request, an amount of change funds apportioned into the cash settlement device 2.

In the flowchart shown in FIG. 15, step S151 is performed by an inventory number acquirer configured to acquire the inventory number of banknotes or coins as change funds in each cash settlement device 2 of the cash management system 1. Step S152 is performed by a number-of-lacking-banknote/coin calculator. When a request is made to supply change funds, the number-of-lacking-banknote/coin calculator calculates, on a denomination-by-denomination basis, the sum of the numbers of a denomination, associated with the request, of banknotes or coins lacking in the cash settlement devices 2 of the cash management system 1 relative to the respective post-replenishment inventory numbers of banknotes or coins therein, based on the inventory number of the denomination of banknotes or coins (change funds). This inventory number is acquired by the inventory number acquirer. Steps S153 to S156 are performed by a dispenser. When the sum of the numbers of each denomination of banknotes or coins lacking is less than the inventory number of the denomination of banknotes or coins in the cashier device 5, the dispenser dispenses, to the cash settlement device 2 associated with the request, a denomination of banknotes or coins, as change funds, that are required to allow the inventory number of banknotes or coins in the cash settlement device 2 to be equal to the post-replenishment inventory number of banknotes or coins therein. On the other hand, when the sum of the numbers of each denomination of banknotes or coins lacking in the cash settlement devices 2 exceeds the number of the denomination of banknotes or coins in the cashier device 5, the dispenser dispenses a denomination of banknotes or coins equal in number to the number calculated according to a predetermined calculation formula as change funds for one of the cash settlement devices 2 associated with the request.

Thus, when a request is made to supply change funds, the cash management system 1 having the above-described configuration acquires the sum of the numbers of banknotes or coins, as change funds, lacking in the cash settlement devices 2 of the cash management system 1. When a comparison between the sum and the inventory number of banknotes or coins in the cashier device 5 shows that the inventory number of banknotes or coins in the cashier device 5 is lower, the cash management system 1 limits the amount of change funds dispensed. This can prevent all the cash from being dispensed to a specific one of the cash settlement devices 2 and prevent change funds from being unable to be dispensed to the other cash settlement devices 2 when the inventory number of banknotes or coins in the cashier device 5 is low.

In addition, the amount of change funds dispensed is limited not based on the fact that the inventory number of banknotes or coins in the cashier device 5 is equal to or less than the nearly empty value, but based on the inventory number of banknotes or coins in each cash settlement device 2 of the cash management system 1. Thus, the cash settlement device 2 that needs to be replenished can be appropriately replenished with change funds.

Thus, when dispensing of cash from the cashier device 5 is limited, the inventory number of banknotes or coins in the cashier device 5 is apportioned to each cash settlement device 2 according to the ratio of the number of banknotes or coins lacking in the cash settlement device 2 to the sum of the numbers of banknotes/coins, as change funds, lacking in the cash settlement devices 2 of the cash management system 1. This allows an appropriate amount of change funds to be assigned to the cash settlement device 2 that needs to be replenished with change funds.

Furthermore, the priority order of the cash settlement devices 2 of the cash management system 1 is previously set according to the corresponding registers 40. If the inventory number of banknotes or coins in the cashier device 5 is apportioned according to the priority order, a relatively large amount of change funds can be assigned, and supplied, to a cash settlement device 2 having higher priority.

In addition, when the total number of banknotes or coins, as change funds, lacking in the cash management system 1 is calculated, and when the inventory number of banknotes or coins in the cashier device 5 is apportioned, if only one or more of the cash settlement devices 2 in which the inventory number of banknotes or coins is equal to or less than the nearly empty value is to be replenished with change funds, the cash settlement device(s) 2 that is/are requested to be replenished can be more appropriately replenished with change funds.

According to the above-described configuration, when a request is made to supply change funds, the cash management device 6 acquires the inventory number of banknotes or coins in each cash settlement device 2 of the cash management system 1. However, the cash management device 6 may be configured to acquire the inventory number of banknotes or coins in the cash settlement device 2 of the cash management system 1 at regular intervals. The cash management device 6 may acquire the inventory number of banknotes or coins in each cash settlement device 2 of the cash management system 1 at regular intervals, and when a request is made to supply change funds, may again acquire the inventory number of banknotes or coins in the cash settlement device 2 of the cash management system 1.

According to the above-described configuration, when a request is made to supply change funds, the number of banknotes or coins, as change funds, lacking at this point in time is calculated, and the inventory number of banknotes or coins in the cashier device is apportioned. However, every time a request is made to supply change funds, the inventory number of banknotes or coins in the cashier device does not have to be apportioned. For example, if, when a request is made to supply change funds, a predetermined time has not elapsed since the last time a request was made to supply change funds, the number of banknotes or coins determined by apportioning the inventory number of banknotes or coins in the cashier device at the last time a request was made to supply change funds may be dispensed without again apportioning the inventory number of banknotes or coins in the cashier device.

A specific description is given according to the first apportionment example described above. Suppose that as described above, immediately after four 10-euro banknotes are dispensed to the first cash settlement device 2, a request is made to replenish the second cash settlement device 2 with change funds. In that case, 10-euro banknotes (in this case, two banknotes) equal in number to the number determined by apportioning the inventory number of banknotes in the cashier device 5 at the last time a request was made to supply change funds is dispensed to the second cash settlement device 2 without apportioning the inventory number of 10-euro banknotes in the cashier device 5 (in this case, six banknotes). If, every time a request is made to supply change funds, the inventory number of banknotes in the cashier device is apportioned, the inventory number of banknotes therein decreases. This also reduces the number of banknotes apportioned to each cash settlement device. If requests are successively made to supply change funds at substantially the same time, the number of banknotes apportioned in response to a later request may be much smaller than that in response to an earlier request.

Suppose that to address this problem, if, when a request is made to supply change funds, a predetermined time has not elapsed since the last time a request was made to supply change funds, the number of banknotes determined by apportioning the inventory number of banknotes in the cashier device at the last time a request was made to supply change funds is dispensed without again apportioning the inventory number of banknotes in the cashier device. In that case, if requests are successively made to supply change funds, change funds can be appropriately dispensed to meet the requests.

As described in the third apportionment example, if replenishing one of the cash settlement devices 2 with change funds prevents the inventory number of banknotes or coins in the cash settlement device 2 from being nearly empty, and a subsequent request is made to replenish another one of the cash settlement devices with change funds, the one of the cash settlement devices 2 can be excluded from the targets in each of which the number of banknotes or coins lacking is to be calculated and to each of which change funds are to be apportioned. This allows change funds to be appropriately dispensed to meet the subsequent request to supply change funds.

If, when a request is made to supply change funds, a predetermined time has not elapsed since the last time a request was made to supply change funds, the cash settlement device 2 replenished with change funds in response to the last request may be excluded from the targets in each of which the number of banknotes or coins lacking is to be calculated and to each of which change funds are to be apportioned. This also allows change funds to be appropriately dispensed to meet a later request to supply change funds.

One denomination has been described above. However, naturally, all of denominations to be handled are treated in the same way. Specifically, the cash management device 6 calculates the total number of each denomination of banknotes or coins lacking in the cash settlement devices 2 of the cash management system 1 relative to the total post-replenishment inventory number of the denomination of banknotes or coins in the cash settlement devices 2 of the cash management system 1, based on the inventory number of the denomination of banknotes or coins, as change funds, in each cash settlement device 2, and compares the total number of the denomination of banknotes or coins to the inventory number of the denomination of banknotes or coins in the cashier device 5 to limit, as necessary, dispensing of a denomination of banknotes or coins lacking.

(Control on Supply of Change Funds in Offline Mode)

As described above, in the cash management system 1, when a person in charge operates the cashier device 5 to request supply of change funds, the cashier device 5 outputs a signal indicating the request to the cash management device 6, which is configured to control how cash is dispensed from the cashier device 5. The cash management device 6 stores and manages information on the post-replenishment inventory number of banknotes or coins in each cash settlement device 2.

Here, if a person in charge operates the cashier device 5 to request the supply of change funds, and communication between the cashier device 5 and the cash management device 6 is offline for any reason, the cashier device 5 cannot dispense change funds.

To improve the convenience, the cashier device 5 may be configured to independently dispense change funds even if communication between the cashier device 5 and the cash management device 6 is offline. However, the cashier device 5 does not store and manage the information on the post-replenishment inventory number of banknotes or coins in each cash settlement device 2. Thus, change funds are dispensed without any limitation according to the request made by the person in charge. This is securely problematic.

To address this problem, in the cash management system 1, if, to improve both convenience and security, the cashier device 5 is operated to request supply of change funds, and communication between the cashier device 5 and the cash management device 6 is offline, the cashier device 5 is configured to dispense the change funds while limiting the dispensing according to preset limitations.

Specifically, limitations in an offline mode are as follows. Specifically, the number of times the person in charge requesting addition of change funds dispenses cash in the offline mode and the total cumulative amount of cash dispensed by the person are limited to the preset number and amount for each currency.

Figure 16:
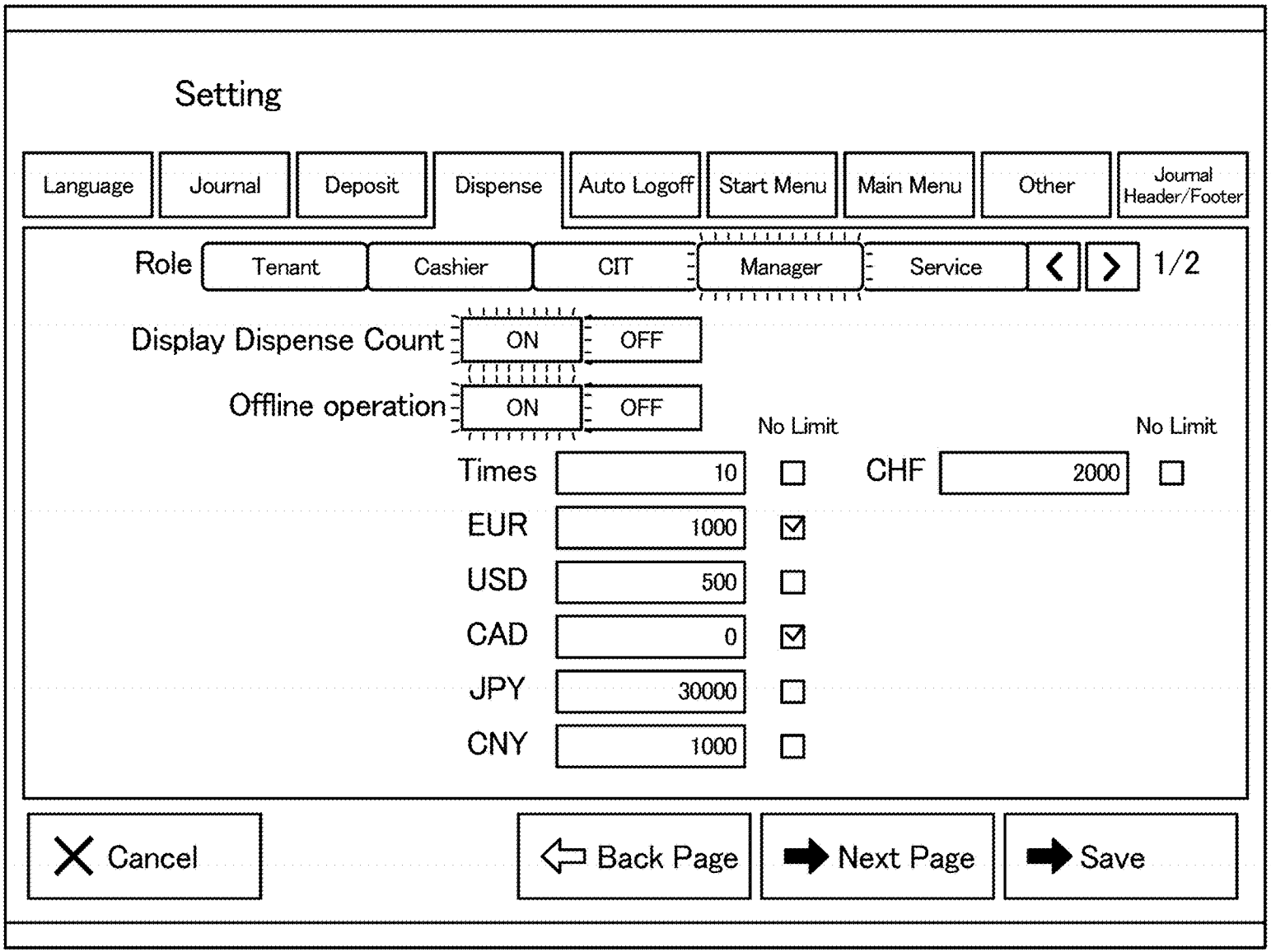
FIG. 16 exemplifies a setting screen relating to dispensing of change funds performed while the cashier device is offline.

Here, the person in charge includes a "person in charge of a tenant," a "cashier," an "operator of a cash-in-transit company", a "manager," and a "maintenance service personnel." The number of times cash is dispensed in the offline mode and the upper limit of the total cumulative amount of cash dispensed are limited for each person in charge. FIG. 16 exemplifies a setting screen SC1 displayed on the cashier device 5, for example, in order to set the number of times cash is dispensed in the offline mode and the upper limit of the total cumulative amount of cash dispensed.

As described above, this setting screen SC1 includes "Tenant," "Cashier," "CIT," "Manager," and "Service" buttons for selecting a person in charge (Role). In the illustrated example, the "Manager" button is chosen.

Further, the setting screen SC1 includes buttons for setting whether or not the cashier device 5 permits the limited dispensing of change funds during the offline mode (i.e., an offline operation). In the illustrated example, an "ON" button is chosen, and an offline operation is set to be permitted.

Further, the setting screen SC1 includes a time field (Times) where the upper limit of the number of times change funds are dispensed during the offline mode is set, and amount fields (EUR, USD, CAD, JPY, CNY, CHF) where the upper limit of the total cumulative amount of change funds dispensed during the offline mode is set for each currency. Data can be entered into these amount fields when an offline operation is set to be permitted.

Operating the operation unit 591 of the cashier device 5 allows necessary numbers to be entered in each field. A check box (No Limit), which is marked when no upper limit is set, is provided to one side of each of the field where the upper limit of the number of times change funds are dispensed during the offline mode is set, and the fields where the upper limit of the total cumulative amount of change funds dispensed is set for each currency.

Entering necessary data on the setting screen SC1 and then choosing the save (Save) button finishes setting an operation to be performed while the cashier device 5 is offline. The settings are stored in the memory 570 of the cashier device 5.

Figure 17:
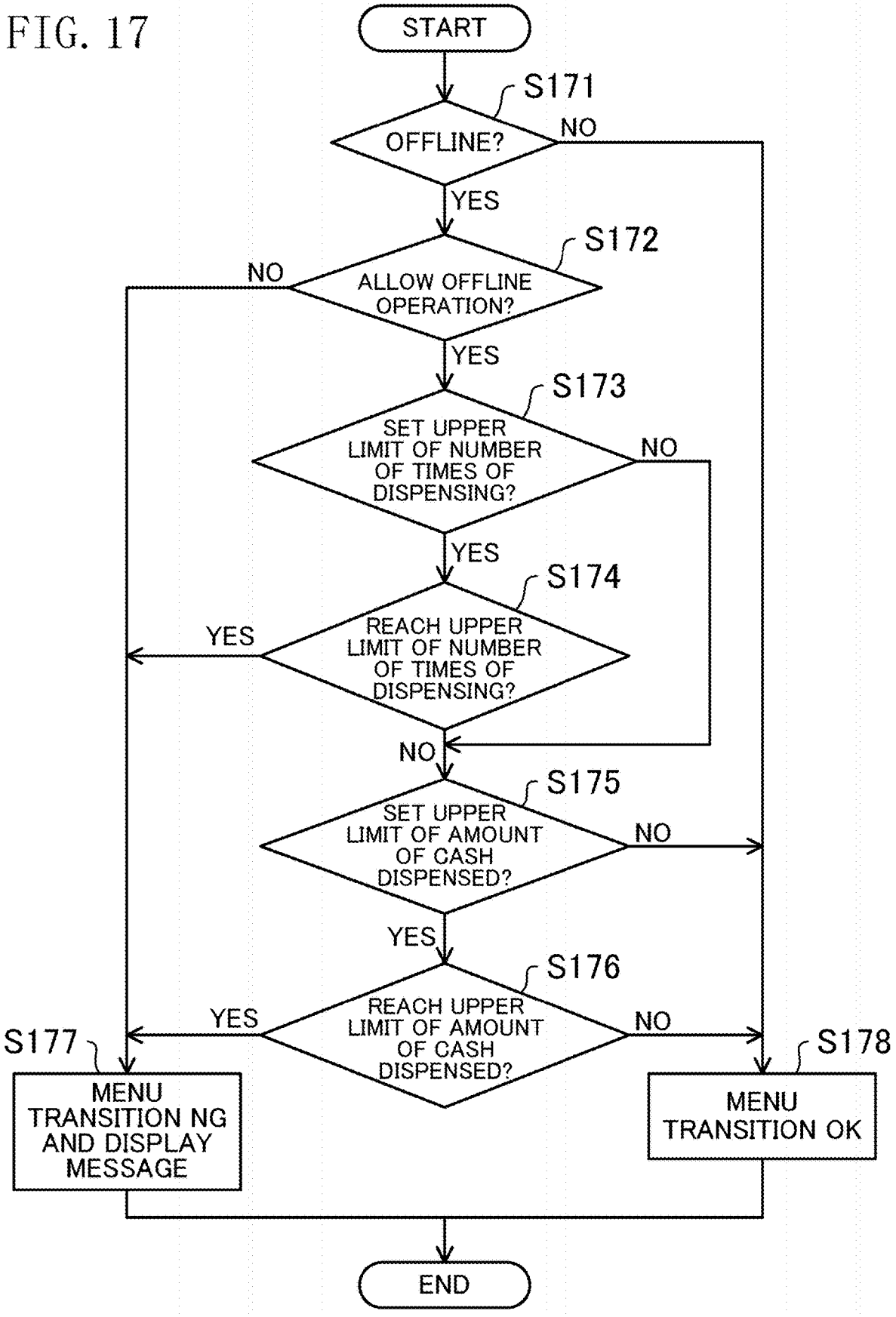
FIG. 17 is a flowchart showing how the cashier device is controlled while offline.

FIG. 17 is a flowchart showing how the cashier device 5 is controlled while offline. This flowchart is started by the person in charge performing an authentication operation in the cashier device 5 and choosing supply of change funds from the start menu displayed on the cashier device 5.

In step S171 after the start, a determination is made whether or not the cashier device is offline. If it is not offline, the process proceeds to step S178. The cashier device 5 is connected to the cash management device 6 via the communication line 12. Thus, the cashier device 5 performs ordinary control of supply of change funds. In other words, the dialog box transitions to another dialog box for requesting supply of change funds. The person in charge operates the cashier device 5 according to the dialog box displayed on the display 592 of the cashier device 5, thereby dispensing change funds.

On the other hand, if a determination is made in step S171 that the cashier device 5 is offline, the process proceeds to step S172. In step S172, a determination is made whether the concerned person in charge is permitted to perform an offline operation. If he or she is not permitted, the process proceeds to step S177. In step S177, the transition to the dialog box for requesting the supply of change funds is prohibited. At this time, for example, a message such as "You cannot dispense cash, because SERVER is not online now." may be displayed on the display 592.

In step S172, when the concerned person in charge is permitted to perform an offline operation, the process proceeds to step S173. In step S173, a determination is made whether or not the upper limit of the number of times the concerned person in charge dispenses cash has been set. If the upper limit has been set, the process proceeds to step S174. If the upper limit has not been set yet, the process proceeds to step S175 without proceeding to step S174.

In step S174, a determination is made whether or not the number of times the concerned person in charge dispenses cash has reached the set upper limit. Here, the "number of times a person in charge dispenses cash" is the number of times the person in charge himself or herself dispenses cash. In other words, for example, if a plurality of cashiers are present, the "number of times a person in charge dispenses cash" corresponds to the number of times the same cashier dispenses cash during the offline mode, but does not correspond to the total number of times the cashiers dispense cash during the offline mode. If the number of times the person in charge dispenses cash has not reached the upper limit, the process proceeds to step S175. If the number of times the person in charge dispenses cash has reached the upper limit, the process proceeds to step S177.

As described above, in step S177, the transition to the dialog box for requesting the supply of change funds is prohibited. At this time, for example, a message such as "You cannot dispense cash, because the dispensing limit is exceeded)" may be displayed on the display 592.

In step S175, a determination is made whether or not the upper limit of the total cumulative amount of cash dispensed by the concerned person in charge has been set. If the upper limit has been set, the process proceeds to step S176. If the upper limit has not been set yet, the process proceeds to step S178. The supply of change funds is not limited by the number of times the person in charge dispenses cash, and the total cumulative amount of cash dispensed is not limited. Thus, in step S178, ordinary control is performed on supply of change funds. In other words, the dialog box transitions to another dialog box for requesting supply of change funds.

In step S176, a determination is made whether or not the total cumulative amount of cash dispensed by the concerned person in charge has reached the set upper limit. Here, the "total cumulative amount of cash dispensed by a person in charge" is also the total cumulative amount of cash dispensed by the person in charge himself or herself. In other words, for example, if a plurality of cashiers are present, the "total cumulative amount of cash dispensed by a person in charge" corresponds to the total cumulative amount of cash dispensed by the same cashier during the offline mode, but does not correspond to the sum of the total cumulative amounts of cash dispensed by the cashiers. If the total cumulative amount of cash dispensed has not reached the upper limit, the process proceeds to step S178. If the total cumulative amount of cash dispensed has reached the upper limit, the process proceeds to step S177. In the same manner as described above, in step S178, ordinary control is performed on supply of change funds. In other words, the dialog box transitions to another dialog box for requesting supply of change funds.

In step S177, the transition to the dialog box for requesting the supply of change funds is prohibited. At this time, for example, a message such as "You cannot dispense cash, because the dispensing limit is exceeded)" may be displayed on the display 592.

As can be seen, the cash management system 1 having the above-described configuration allows change funds to be dispensed from the cashier device 5 even during the offline mode. As a result, convenience is improved. Meanwhile, in the offline mode, the number of times change funds are dispensed and/or the total cumulative amount of cash dispensed can be limited as necessary. This can improve security even while the cash management device 6 cannot manage the system. The counts of the number of times change funds are dispensed and the total cumulative amount of cash dispensed are reset if the state shifts from an offline state to an online state.

The present disclosure is applicable not only to the cash management system 1 having the above-described configuration, but also to the cash management system 1 having another configuration except the above-described configuration.

For example, according to the foregoing configuration, the cashier device 5 and the cash management device 6 are separate from each other. However, a cashier device and a cash management device may be integrated together.

DESCRIPTION OF REFERENCE CHARACTERS

1 Cash Management System.
12 Communication Line (Transmission Line)
2 Cash Settlement Device
5 Cashier Device
6 Cash Management Device
40 Register

The invention claimed is:

1. A cash management system, comprising:

a plurality of cash settlement devices operable to dispense cash stored in a storage unit through an outlet as change funds;

a cashier device operable to store, in a storage unit, sales proceeds collected from the plurality of cash settlement devices, and when the plurality of cash settlement devices are replenished with the change funds, operable to dispense the cash stored in the storage unit through an outlet; and a cash management device connected to the plurality of cash settlement devices and the cashier device via a communication line to exchange a signal with each of the plurality of cash settlement devices and the cashier device, the cash management device including an arithmetic processing unit executing processing based on information acquired through the communication line, wherein:

the cash management device compares the amount of the change funds that the plurality of cash settlement devices needs to be replenished with an inventory number in the cashier device, and limits the amount of the change funds dispensed from the cashier device when the amount of the change funds that the plurality of cash settlement devices needs to be replenished with exceeds the inventory number in the cashier device.

2. The cash management system of claim 1, wherein a post-replenishment inventory number of banknotes or coins in each cash settlement device is determined on a denomination-by-denomination basis, the post-replenishment inventory number serving as a standard for supplying the change funds, the cash management device acquires an inventory number of banknotes or coins as the change funds in each cash settlement device of the cash management system, and when a request is made to supply the change funds, calculates the total number of an associated denomination of banknotes or coins lacking in each cash settlement device of the cash management system relative to the post-replenishment inventory number, based on the inventory number of the denomination of the change funds associated with the request, the cash management device further instructs the cashier device to dispense the denomination of banknotes or coins as the change funds for the cash settlement device associated with the request when the total number of a denomination of the banknotes or coins lacking is equal to or less than an inventory number of the denomination of banknotes or coins in the cashier device, the dispensed banknotes or coins being required to allow the inventory number of banknotes or coins in the cash settlement device to be equal to the post-replenishment inventory number, and instructs the cashier device to, dispense the denomination of banknotes or coins as the change funds for the cash settlement device associated with the request when the total number of a denomination of the banknotes or coins lacking exceeds the inventory number of the denomination of banknotes or coins in the cashier device, the number of the dispensed banknotes or coins being calculated according to a preset calculation formula.

3. The cash management system of claim 2, wherein when the total number of a denomination of banknotes or coins lacking exceeds the inventory number of banknotes or coins in the cashier device, the cash management device is operable to perform an apportionment that apportions the inventory number of the banknotes or coins in the cashier device among one or more of the cash settlement devices in which change funds are lacking, according to a ratio of the number of the denomination of banknotes or coins lacking in the one or more of the cash settlement devices to the total number of the denomination of banknotes or coins lacking, and the cash management device instructs the cashier device to dispense the apportioned number of the denomination of banknotes or coins.

4. The cash management system of claim 3, wherein every time the cashier device dispenses the change funds to any one of the plurality of cash settlement devices, the cash management device performs the apportionment.

5. The cash management system of claim 4, wherein a priority order of the plurality of cash settlement devices is previously determined according to the respective corresponding registers, and the cash management device apportions the inventory number of the banknotes or coins in the cashier device in accordance with the priority order.

6. The cash management system of claim 5, wherein the post-replenishment inventory numbers of banknotes or coins in the plurality of cash settlement devices are determined in accordance with the priority order so that the post-replenishment inventory number of banknotes or coins in one of the plurality of cash settlement devices with higher priority is higher, and the cash management device calculates a total number of each denomination of banknotes or coins lacking, based on the post-replenishment inventory number determined in accordance with the priority order, and apportions the inventory number of banknotes or coins in the cashier device as cash for supplying the denomination of the banknotes or coins lacking.

7. The cash management system of claim 4, wherein when an amount of the change funds in a respective cash settlement device is smaller than a preset reference amount, the respective cash settlement device determines that the amount of the change funds is insufficient, and when a request is made to supply the change funds, the cash management device calculates the total number of a denomination of banknotes or coins lacking relative to the post-replenishment inventory number in the respective cash settlement device in which the change funds are lacking.

8. The cash management system of claim 4, wherein when a request is made to supply the change funds, the cash management device acquires the inventory number of the change funds in each cash settlement device of the cash management system.

9. The cash management system of claim 3, wherein a priority order of the plurality of cash settlement devices is previously determined according to the respective corresponding registers, and the cash management device apportions the inventory number of the banknotes or coins in the cashier device in accordance with the priority order.

10. The cash management system of claim 9, wherein the post-replenishment inventory numbers of banknotes or coins in the plurality of cash settlement devices are determined in accordance with the priority order so that the post-replenishment inventory number of banknotes or coins in one of the plurality of cash settlement devices with higher priority is higher, and the cash management device calculates a total number of each denomination of banknotes or coins lacking, based on the post-replenishment inventory number determined in accordance with the priority order, and apportions the inventory number of banknotes or coins in the cashier device as cash for supplying the denomination of the banknotes or coins lacking.

11. The cash management system of claim 10, wherein when an amount of the change funds in a respective cash settlement device is smaller than a preset reference amount, the respective cash settlement device determines that the amount of the change funds is insufficient, and when a request is made to supply the change funds, the cash management device calculates the total number of a denomination of banknotes or coins lacking relative to the post-replenishment inventory number in the respective cash settlement device in which the change funds are lacking.

12. The cash management system of claim 10, wherein when a request is made to supply the change funds, the cash management device acquires the inventory number of the change funds in each cash settlement device of the cash management system.

13. The cash management system of claim 9, wherein when an amount of the change funds in a respective cash settlement device is smaller than a preset reference amount, the respective cash settlement device determines that the amount of the change funds is insufficient, and when a request is made to supply the change funds, the cash management device calculates the total number of a denomination of banknotes or coins lacking relative to the post-replenishment inventory number in the respective cash settlement device in which the change funds are lacking.

14. The cash management system of claim 9, wherein when a request is made to supply the change funds, the cash management device acquires the inventory number of the change funds in each cash settlement device of the cash management system.

15. The cash management system of claim 3, wherein when an amount of the change funds in a respective cash settlement device is smaller than a preset reference amount, the respective cash settlement device determines that the amount of the change funds is insufficient, and when a request is made to supply the change funds, the cash management device calculates the total number of a denomination of banknotes or coins lacking relative to the post-replenishment inventory number in the respective cash settlement device in which the change funds are lacking.

16. The cash management system of claim 3, wherein when a request is made to supply the change funds, the cash management device acquires the inventory number of the change funds in each cash settlement device of the cash management system.

17. The cash management system of claim 2, wherein when an amount of the change funds in a respective cash settlement device is smaller than a preset reference amount, the respective cash settlement device determines that the amount of the change funds is insufficient, and when a request is made to supply the change funds, the cash management device calculates the total number of a denomination of banknotes or coins lacking relative to the post-replenishment inventory number in the respective cash settlement device in which the change funds are lacking.

18. The cash management system of claim 2, wherein when a request is made to supply the change funds, the cash management device acquires the inventory number of the change funds in each cash settlement device of the cash management system.

19. The cash management system of claim 2, wherein the cash management device acquires the inventory number of banknotes or coins as the change funds in each cash settlement device of the cash management system at regular intervals.

20. A cashier device of a cash management system, the cash management system including a plurality of cash settlement devices dispensing cash stored in a storage unit through an outlet as change funds, and a cashier device connected to the plurality of cash settlement devices via a communication line to exchange a signal, storing, in a storage unit, sales proceeds collected from the plurality of cash settlement devices, and dispensing through the outlet, the cash stored in the storage unit when the plurality of cash settlement devices are replenished with the change funds, wherein the cashier device includes an arithmetic processing unit executing processing based on information acquired through the communication line, compares the amount of the change funds that the plurality of cash settlement devices needs to be replenished with an inventory number in the cashier device, and limits the amount of the change funds when the amount of the change funds that the plurality of cash settlement devices needs to be replenished with exceeds the inventory number in the cashier device.

21. A cash management method for a cash management system, the cash management system comprising:

a plurality of cash settlement devices dispensing cash stored in a storage unit through an outlet as change funds;

a cashier device storing, in a storage unit, sales proceeds collected from the plurality of cash settlement devices, and when the plurality of cash settlement devices are replenished with the change funds, dispensing, through the outlet, the cash stored in the storage unit; and a cash management device connected to the plurality of cash settlement devices and the cashier device though a communication line to exchange a signal with each of the plurality of cash settlement devices and the cashier device, and including an arithmetic processing unit executing processing based on information acquired through the communication line, the method comprising:

comparing the amount of the change funds that the plurality of cash settlement devices needs to be replenished with an inventory number in the cashier device, and limiting the amount of the change funds when the amount of the change funds that the plurality of cash settlement devices needs to be replenished with exceeds the inventory number in the cashier device.

* * * * *